US007435025B2

(12) United States Patent
Tanahashi et al.

(10) Patent No.: US 7,435,025 B2
(45) Date of Patent: Oct. 14, 2008

(54) IMAGE RECORDING APPARATUS

(75) Inventors: Naokazu Tanahashi, Nagoya (JP); Yukio Shiohara, Nagoya (JP); Yusaku Watanabe, Nagoya (JP); Kosuke Nukui, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 394 days.

(21) Appl. No.: 11/071,194

(22) Filed: Mar. 4, 2005

(65) Prior Publication Data

US 2005/0196216 A1 Sep. 8, 2005

(30) Foreign Application Priority Data

Mar. 5, 2004 (JP) ..... 2004-062761
Jun. 25, 2004 (JP) ..... 2004-188294

(51) Int. Cl.
*B41J 11/58* (2006.01)
*B65H 3/66* (2006.01)
*B65H 3/06* (2006.01)

(52) U.S. Cl. ..... 400/625; 271/113; 271/117; 271/118; 271/109

(58) Field of Classification Search ..... 400/611, 400/625; 271/10.01, 109, 113, 117, 118, 271/121, 104; 399/16
See application file for complete search history.

(56) References Cited

U.S. PATENT DOCUMENTS 5,456,456 A 10/1995 Abe et al.
6,293,541 B1 * 9/2001 Horiuchi et al. ..... 271/184
6,298,214 B1 * 10/2001 Koga ..... 399/322
6,651,974 B2 11/2003 Kawarama et al.
6,939,068 B2 * 9/2005 Rawlings et al. ..... 400/718
2001/0028141 A1 * 10/2001 Kotaka et al. ..... 271/10.11
2003/0047862 A1 3/2003 Komatsu

FOREIGN PATENT DOCUMENTS

EP 1 132 215 A2 9/2001
JP 61-132351 U 8/1986
JP 64-045632 U 3/1989

(Continued)

OTHER PUBLICATIONS

Office Action in Japanese Application No. 2004-062761 mailed Sep. 20, 2007.

*Primary Examiner*—Judy Nguyen
*Assistant Examiner*—M. L. Ferguson-Samreth
(74) *Attorney, Agent, or Firm*—Banner & Witcoff, Ltd

(57) ABSTRACT

An image recording apparatus includes an accommodation section, an image recording section, an outer arcuate guide member, an inner arcuate guide member, and a feeding section. Recording media are stacked on the accommodation section. The image recording section forms an image on a recording medium conveyed in a conveyance direction. The outer arcuate guide member connects in a U-shape the accommodation section with the image recording section. The outer arcuate guide member guides the recording medium from a downstream end portion of the accommodation section to an insertion port of the image recording section. The inner arcuate guide member is disposed to be separate from the outer arcuate guide member. A passage is defined between the outer arcuate guide member and the inner arcuate guide member. The passage allows the recording medium to displace in a thickness direction thereof.

25 Claims, 26 Drawing Sheets

FOREIGN PATENT DOCUMENTS

| | | | | |
|---|---|---|---|---|
| JP | 2-127333 | A | | 5/1990 |
| JP | 02-086939 | U | | 7/1990 |
| JP | 05208756 | | * | 8/1993 |
| JP | 06-032488 | A | | 2/1994 |
| JP | 07-251955 | A | | 10/1995 |
| JP | 08-108963 | A | | 4/1996 |
| JP | 2001-138592 | | | 5/2001 |
| JP | 2002-249248 | | | 9/2002 |
| JP | 2002-321838 | | | 11/2002 |

* cited by examiner

IMAGE RECORDING APPARATUS

BACKGROUND OF THE INVENTION

1. Field of the Invention

The present invention relates to an image recording apparatus.

2. Description of the Related Art

U.S. Pat. No. 6,651,974 discloses an image recording apparatus such as a printer, a copying machine, or a facsimile machine in which an accommodation section for accommodating recording media such as papers, OHP sheets, etc. and an image recording section for recording an image on each of the recording media are arranged in a vertical direction and are connected with each other through a U-shaped passage so that each recording medium can be conveyed from the accommodation section through the passage to the image recording section. The U-shaped passage has a pair of curved guide members for positioning the recording medium from both sides in a thickness direction of the recording medium. In the middle of the U-shaped passage, there is disposed conveyance unit such as pinch rollers, which tightly sandwich the recording medium therebetween and are rotatingly driven to convey the recording medium. Also, another conveyance unit such as a feeding roller is arranged in the accommodation section to feed the recording medium into the passage, and still another conveyance unit such as a regulation roller is arranged in the image recording section to draw the recording medium from the passage.

SUMMARY OF THE INVENTION

In the image recording apparatus disclosed in U.S. Pat. No. 6,651,974, the recording medium should be always conveyed through the U-shaped passage in a uniform posture (that is, in a uniformly curved state). Therefore, in this type of image recording apparatus, if the conveyance unit including the pinch rollers and so forth is omitted for the sake of structural simplicity, when a pulling force is applied to the recording medium from the separate conveyance unit provided outside the passage, the recording medium is likely to be pulled by force to exert an excessive load to the separate conveyance unit, whereby the recording medium may be inadequately conveyed.

Accordingly, the present invention has been made in an effort to solve the problems described above, and the invention provides an image recording apparatus, which can reliably convey a recording medium while accomplishing structural simplicity.

According to one embodiment of the invention, an image recording apparatus includes an accommodation section, an image recording section, an outer arcuate guide member, an inner arcuate guide member, and a feeding section Sheet-like recording media are stacked on the accommodation section. The image recording section forms an image on a recording medium conveyed in a conveyance direction. The accommodation section and the image recording section are arranged in an up and down direction. The outer arcuate guide member connects in a U-shape the accommodation section with the image recording section. The outer arcuate guide member guides the recording medium from a downstream end portion of the accommodation section in the conveyance direction to an insertion port of the image recording section. The inner arcuate guide member is disposed to be separate from the outer arcuate guide member. A passage is defined between the outer arcuate guide member and the inner arcuate guide member. The passage allows the recording medium conveyed to displace in a thickness direction of the recording medium. The feeding section separates one of the stacked recording media from the remaining recording media to feed the one of the recording media to the passage.

Since the passage for allowing the recording medium to move in the thickness direction of the recording medium is defined between the outer arcuate guide member and the inner arcuate guide member, freedom is provided in a posture of the recording medium, which is conveyed. Thus, it is possible to reliably convey the recording medium without using pinch rollers. As a result, since a structure of the image recording apparatus is simplified, it is possible to miniaturize the image recording apparatus and reduce a manufacturing cost.

DETAILED DESCRIPTION OF THE PREFERRED EMBODIMENTS

A first embodiment of the present invention will be described with reference to FIGS. 1 through 12.

Figure 1:
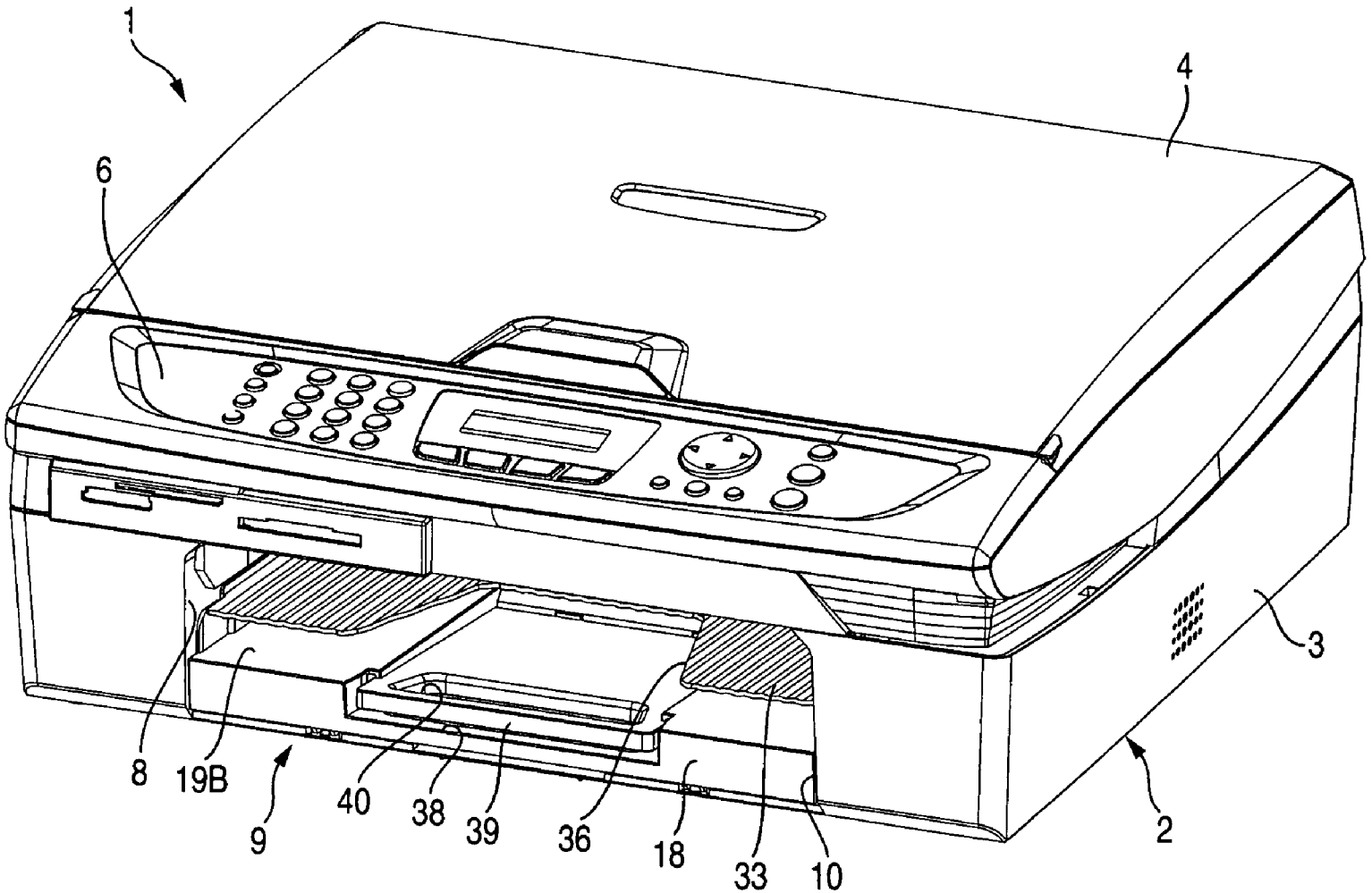
FIG. 1 is a perspective view illustrating an image recording apparatus in accordance with a first embodiment of the present invention.
Figure 2:
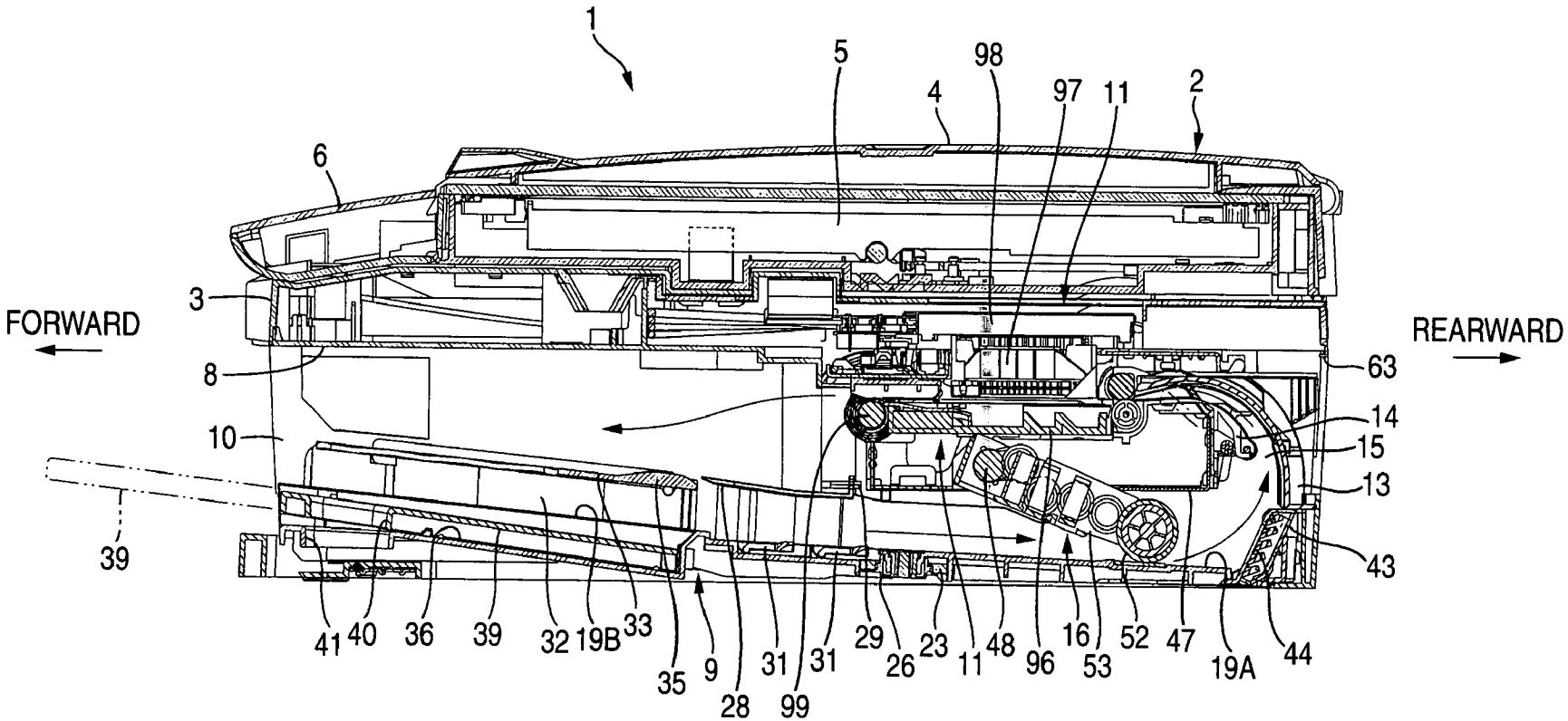
FIG. 2 is a sectional view of the image recording apparatus.

FIG. 1 is a perspective view illustrating an outer appearance of an image recording apparatus 1 in accordance with the first embodiment of the present invention. FIG. 2 is a sectional view of the image recording apparatus 1. In the following description, upward and downward directions will be determined based on FIG. 2. Also, in respect of forward and rearward directions, a direction facing the left side of FIG. 2 will be considered as the forward direction.

The image recoding apparatus 1 according to this first embodiment serves as a multifunction device, which has a facsimile function, a printer function, a copier function, and a scanner function. The image recording apparatus 1 includes a casing 2, which substantially has the shape of a box. When viewed from the top, the casing 2 defines a substantially square configuration having a side which is a size greater than a longer side of an A4 size paper. The casing 2 includes an apparatus body 3, which has a substantially box-shape, and a cover 4, which is placed on and covers the apparatus body 3. The cover 4 can be opened and closed with respect to the apparatus body 3. The cover 4 has a reading unit 5 for reading an image and an operation panel 6.

The apparatus body 3 defines at a widthwise center portion thereof an opening 8, which opens toward the forward direction. The lower part of the opening 8 serves as a tray receiving portion 10, which can receive a feeding tray 9 (serving as an accommodation section) for accommodating sheet-like recording media (not shown) such as papers, OHP sheets, and so forth. Inward (rearward) of the opening 8, an image recording section 11 for forming an image on a recording medium is located above the tray receiving portion 10. Also, inward of the image recording section 11, an outer arcuate guide member 13 and an inner arcuate guide masher 14 are provided. A U-shaped free passage 15 is defined between the outer and inner arcuate guide members 13 and 14 to connect a leading end of the feeding tray 9 received in the tray receiving portion 10 to a rear end of the image recording section 11. A feeding section 16 for feeding a recording medium from the feeding tray 9 toward the image recording section 11 is provided between the image recording section 11 and the feeding tray 9. In the rage recording apparatus 1, as shown by the arrows in FIG. 2, each of the recording media accommodated in the feeding tray 9 is fed into the free passage 15 by the feeding section 16, and reaches the image recording section 11 after passing through the free passage 15. After an image is formed on the recording medium in the image recording section 11, the recording medium is discharged onto the upper surface of the front part of the feeding tray 9. Also, in the apparatus body 3, there are provided a driving unit (not shown) for driving the feeding section 16, etc. and a control circuit (not shown) for controlling operation of various components.

Next, configuration of the various components, which constitute the image recording apparatus 1 according to this embodiment, will be described in detail.

Figure 3:
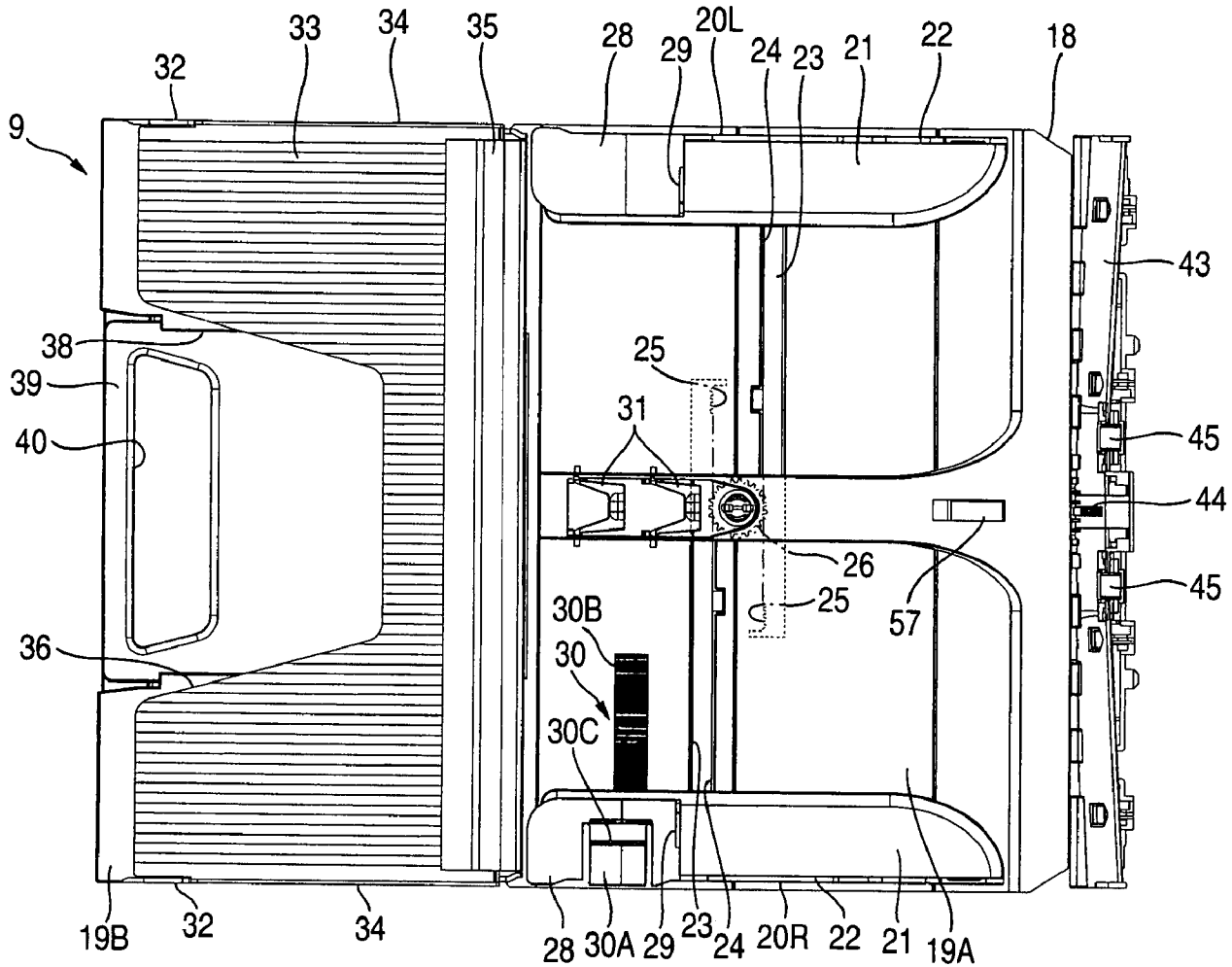
FIG. 3 is a plan view of a feeding tray.
Figure 4:
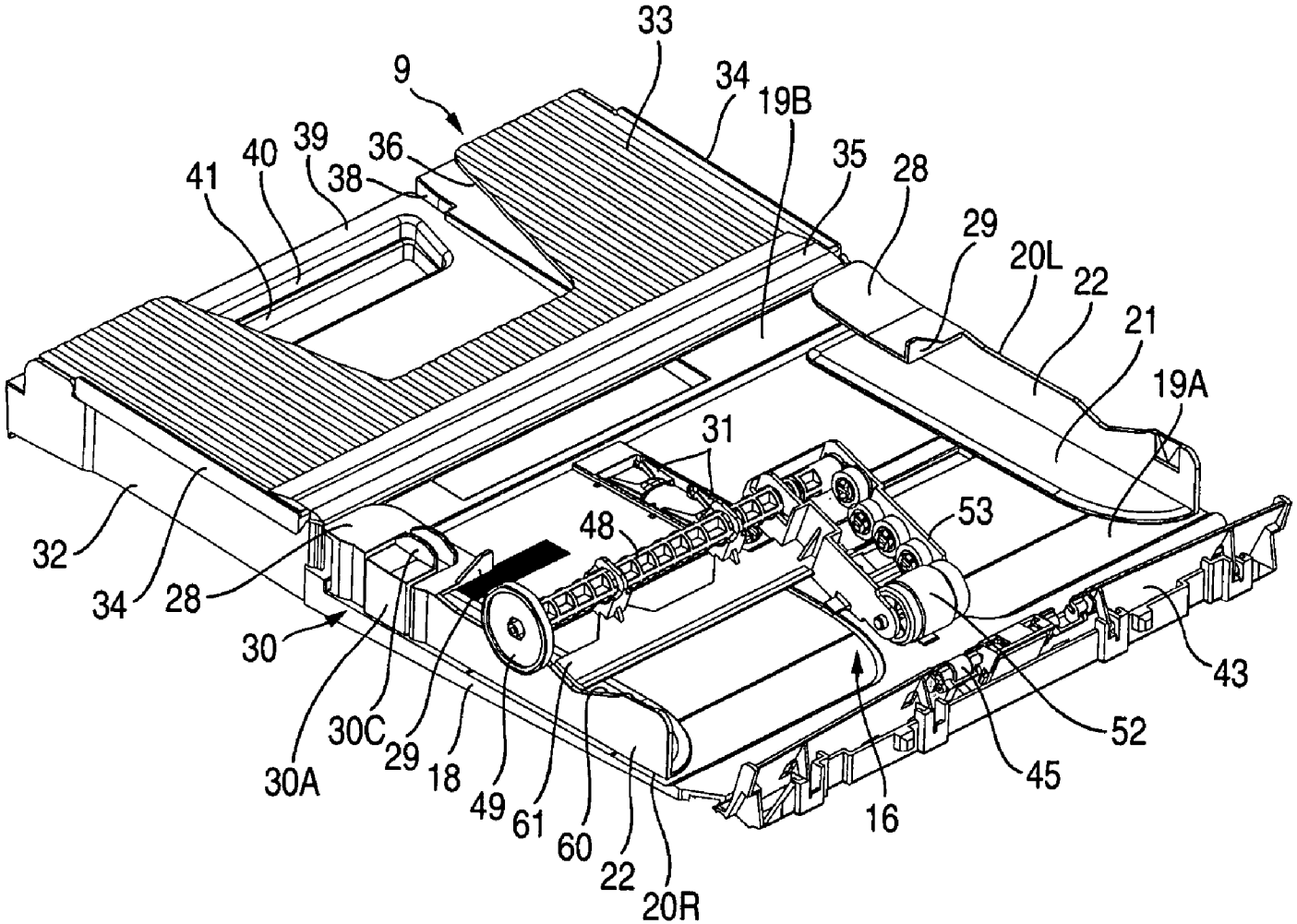
FIG. 4 is a perspective view illustrating the feeding tray and a feeding section.

First, the feeding tray 9 will be described with reference to FIGS. 3 and 4. FIG. 3 is a plan view of the feeding tray 9. FIG. 4 is a perspective view illustrating the feeding tray 9 and the feeding section 16 arranged on the apparatus body 3 side. The feeding tray 9 can be removed from the apparatus body 3 by being horizontally pulled from the tray receiving portion 10, and can be inserted into the apparatus body 3 by being horizontally pushed into the tray receiving portion 10. The feeding tray 9 has a rectangular base plate 18. When viewed in its entirety from the top, the feeding tray 9 has a thin dish-shape, which is substantially equal to an A4 size. The base plate 18 allows recording media to be accommodated on the upper surface thereof. A substantially rear half of the upper surface of the base plate 18 serves as a rear accommodation surface 19A, and a substantially front half of the upper surface of the base plate 18 serves as a front accommodation surface 19B. Both of the accommodation surfaces 19A and 19B are inclined downward toward a downstream side of a feeding direction of the recording medium, and the front accommodation surface 19B has an inclination angle which is greater than that of the rear accommodation surface 19A (see FIG. 2).

On the rear accommodation surface 19A, a pair of side end guides 20R and 20L are provided to be spaced apart from each other in leftward and rightward directions. Each of the side end guides 20R and 20L has a bottom wall portion 21, which extends along the rear accommodation surface 19A in the feeding direction of the recording medium. The bottom wall 21 extends from a position, which is slightly forward of the rear end of the rear accommodation surface 19A, to the front end of the rear accommodation surface 19A. A guide wall 22 is vertically uprighted on each bottom wall portion 21 at the widthwise outer end of the base plate 18. The guide wall 22 has the same length as the bottom wall portion 21 and extends in the forward and rearward directions (that is, a conveyance direction of the recording medium). Linear guide bars 23 are respectively formed on the lower surfaces of the bottom wall portions 21 to extend toward the counterpart side end guides 20R and 20L. The two linear guide bars 23 are arranged parallel to each other to be spaced apart by a predetermined distance, and are respectively fitted into grooves 24 which are defined on the base plate 18 in the leftward and rightward directions. By bringing the bottom wall portions 21 into sliding contact with the rear accommodation surface 19A and by sliding the linear guide bars 23 along the grooves 24, both of the side end guides 20R and 20L can be displaced in the leftward and rightward directions (that is, a direction perpendicular to the conveyance direction of the recording medium). The linear guide bars 23 are respectively formed on their confronting edges with rack gears 25. The rack gears 25 are meshed with a pinion gear 26, which is rotatable and provided at a widthwise center position on the base plate 18. Therefore, since the side end guides 20R and 20L are connected to each other via the rack gears 25 and the pinion gear 26, the side end guides 20R and 20L can be moved in an interlocked manner so that distances between the respective guide walls 22 and the widthwise center of the base plate 18 are equal to each other. When the side end guides 20R and 20L are moved so as to have a maximum width (a state of FIG. 3), a distance between the guide walls 22 substantially corresponds to a size of a short side (that is, a width) of the A4 size paper.

In the side end guides 20R and 20L, overhanging portions 28 protrude from the upper end of the guide walls 22 adjacent to the front ends of the guide walls 22 to be placed above the bottom wall portions 21, respectively. A stopper 29 is vertically uprighted at the rear end of each overhanging portion 28. The stoppers 29 are located below a discharge roller 99 as will be described later and function to prevent discharged recording medium from being moved rearward beyond the overhanging portions 28. A position adjustment portion 30 is provided at the front end of the right side end guide 20R to maintain the side end guides 20R and 20L at a desired position. The position adjustment portion 30 includes an elastic piece 30A, which has a U-shaped section, to extend along the bottom wall portion 21, the guide wall 22 and the overhanging portion 28. In a state in which a force is not externally applied to the elastic piece 30A, an engagement projection (not shown), which is formed on the lower surface of the elastic piece 30A, is engaged with a deviation prevention portion 30B, which is secured to the rear accommodation surface 19A to extend in the leftward and rightward directions and which has a plurality of depressions, whereby the side end guides 20R and 20L can be positioned. By holding a manipulation portion 30C provided on the upper end of the elastic piece 30A, the elastic piece 30A is elastically deformed, whereby the engagement between the engagement projection and the deviation prevention portion 30B is released and it is possible to move the side end guides 20R and 20L in the leftward and rightward directions as desired.

A pair of positioning ribs 31 capable of being erected and falling are arranged in the first and rearward directions at the widthwise center portion of the rear accommodation surface 19A. By erecting one of these positioning ribs 31, a position of a recording medium having a postal card size or a standard L size can be determined between the corresponding positioning rib 31 and a guide plate 43 which is installed at the rear end of the rear accommodation surface 19A as will be described later.

Fixed side wall portions 32 extending in the forward and rearward direction are vertically uprighted at both side end positions of the base plate 18 in a region corresponding to the front accommodation surface 19B. The fixed side wall portions 32 are flush with the guide walls 22, respectively, when the side end guides 20R and 20L are moved to have the maximum width. A cover element 33 is placed on the upper ends of the fixed wall portions 32 to cover the recording media accommodated on the base plate 18 and to straddle the space between the fixed side wall portions 32. The cover element 33 is formed at both side ends thereof with skirt portions 34. By fitting the skirt portions 34 into the upper ends of the fixed side wall portions 32, the cover element 33 is attached. The cover element 33 is inclined downward in the rearward direction so that the cover element 33 is substantially parallel to the front accommodation surface 19A. The cover element 33 is detachable from the fixed wall portions 32. A protruded portion 35 is formed on the rear edge of the cover element 33 and along the upper surface of the cover element 33. The front ends of the overhanging portions 28 of the side end guides 20R and 20L have substantially the same height as the protruded portion 35. The cover element 33 defines at the widthwise center portion thereof a cut-away portion 36 which opens forward.

The front accommodation surface 19B of the base plate 18 defines at the widthwise center portion thereof a support member receiving space 38, which is rectangular in section and opens forward. An auxiliary support member 39, which has a shape of a rectangular plate when viewed from the top, is mounted on the support member receiving space 38. The auxiliary support member 39 can be moved in the forward and rearward directions. When not in use, the entire auxiliary support member 39 is received in the support member receiving space 38 as shown by the solid line in FIG. 2, and when in use, the auxiliary support member 39 is extended forward out of the support ember receiving opening 38 by a predetermined distance as shown by the two-dot chain line in FIG. 2. A finger grip hole 40, which is narrow and penetrates vertically, is defined through a front end portion of the auxiliary support member 39 to extend in the leftward and rightward directions. A second finger grip hole 41 is defined through the bottom of the support member receiving space 38 at a position which corresponds to the finger grip hole 40.

A guide plate 43 is mounted to the rear end of the base plate 18 to extend across the entire width of the base plate 18. The front surface of the guide plate 43 is inclined upward. If the feeding section 16 as will be described later pushes recording media accommodated on the base plate 18 toward the guide plate 43, one of the recording media is separated from the other recording media, and a leading end of the separated recording medium is guided upward by the guide plate 43. The guide plate 43 is slightly curved so that the widthwise (leftward and rightward) center portion of the guide plate 43 projects forward. A separating member 44 made of metal is mounted at the widthwise center portion of the guide plate 43 to overlap the projecting portion of the guide plate 43. The separating member 44 has a plurality of gear teeth, which are arranged in upward and downward directions to be spaced apart from one another at regular intervals. Distal ends of the respective gear teeth slightly project out of the front surface of the guide plate 43. When two or more recording media are fed by the feeding section 16 in an overlapped state, since the recording media abut against the gear teeth, only one recording medium can be separated. Adjacent to the projecting portion of the guide plate 43, a pair of auxiliary rollers 45 are respectively provided at both sides of the separating member 44 in the widthwise direction.

A cam portion 60 is formed on the right side end guide 20R to pivot a feeding roller 52 and an arm member 53 at a time when inserting and pulling the feeding tray 9 into and train the apparatus body 3. The cam portion 60 is formed on the upper end of and adjacent to the rear end of the guide wall 22 of the right side end guide 20R to change in its height in the forward and rearward directions when measured from the bottom of the base plate 18. As shown in FIG. 6, the cam portion 60 is formed in that an inclined surface 60A, which is inclined downward in the rearward direction, an inclined surface 60B, which is inclined upward in the rearward direction, and a horizontal portion 60C, which has a substantially constant height when measured from the bottom of the base plate 18 are sequentially arranged in the rearward direction. The horizontal portion 60C extends to the rear end of the guide wall 22, and has the same height as the upper end of the guide plate 43.

Figure 5:
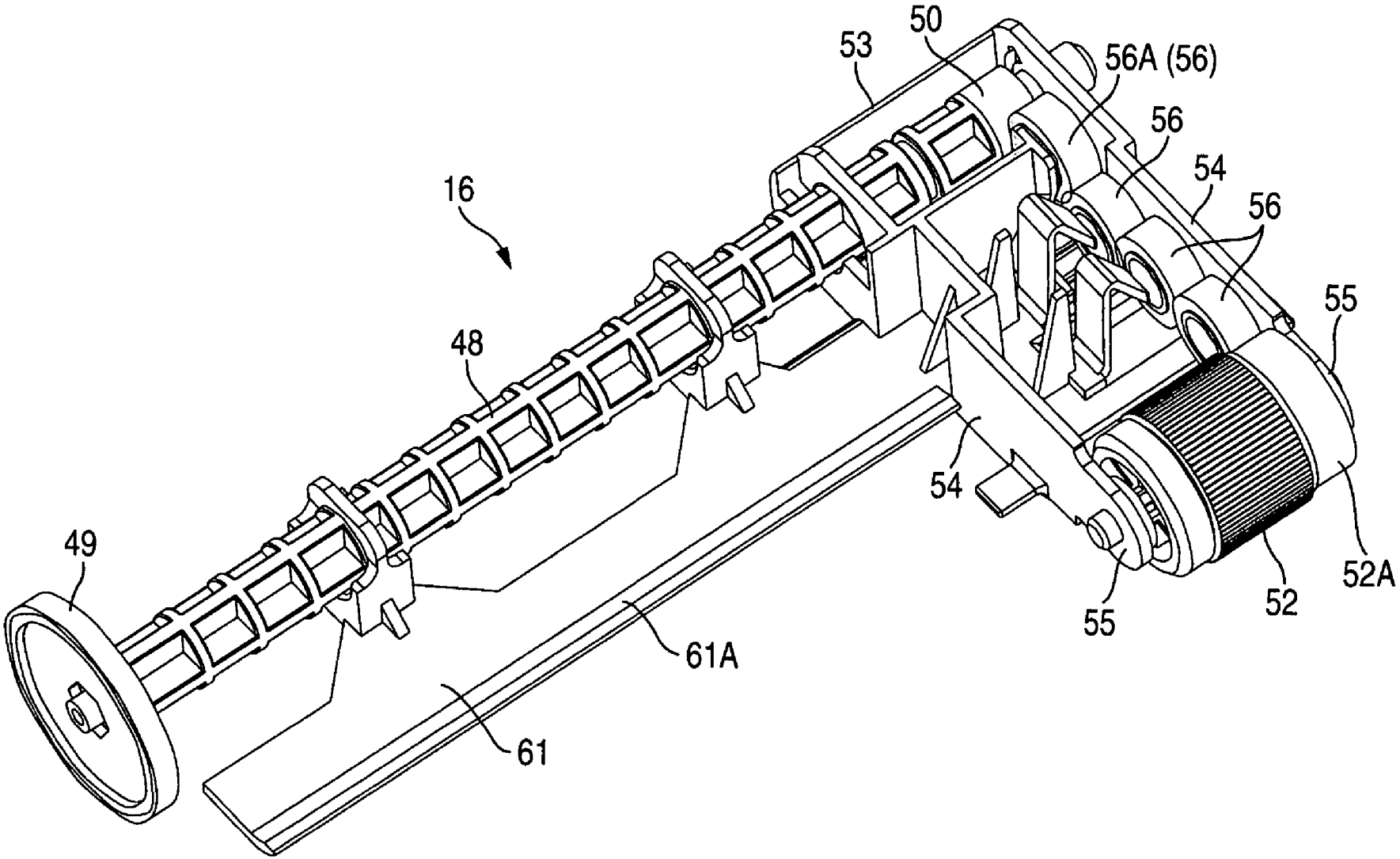
FIG. 5 is a perspective view of the feeding section.
Figure 6A:
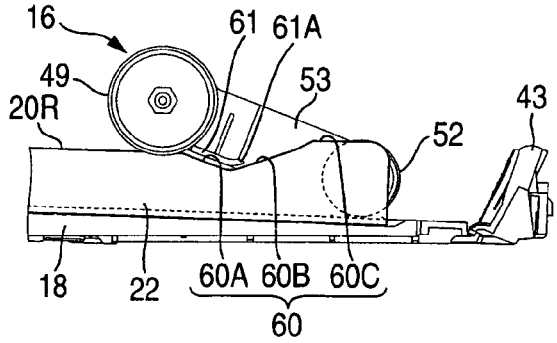
FIGS. 6A through 6E are side views illustrating operation of the feeding tray and the feeding section.
Figure 6B:
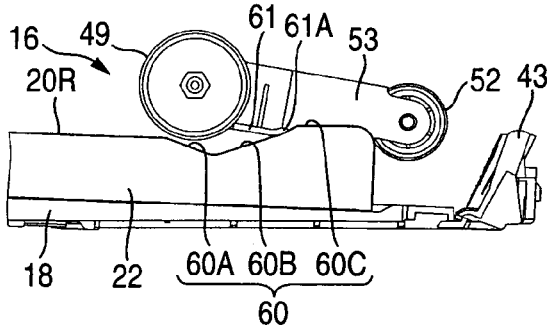
Figure 6C:
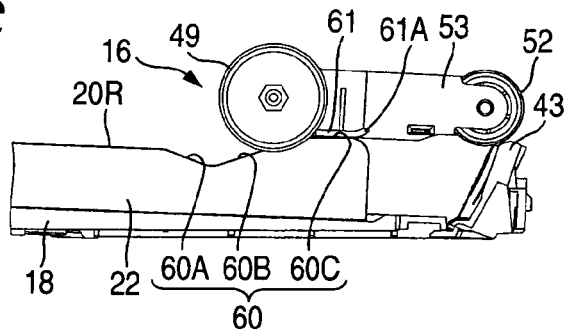
Figure 6D:
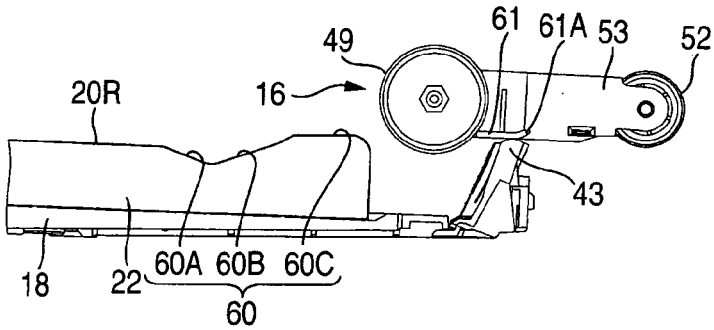
Figure 6E:
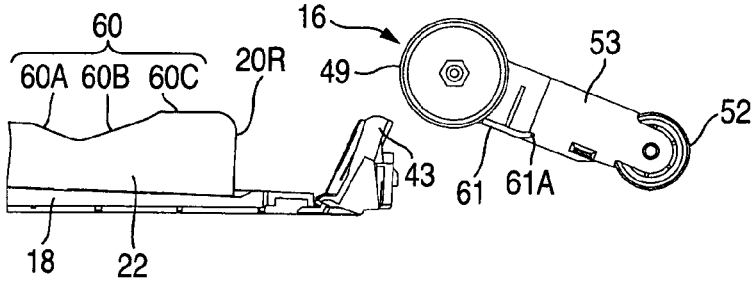

Hereinbelow, the feeding section 16 for feeding the recording medium will be described with reference to FIGS. 2 and 5. FIG. 5 is a perspective view of the feeding section 16.

A box-shaped frame 47, which is thin and long in the leftward and rightward directions, is provided in the apparatus body 3 to be located rearward of and above the feeding tray 9. A support shaft 48 is rotatably disposed in the frame 47 to extend in the leftward and rightward directions (that is, in a direction perpendicular to the feeding direction of the recording medium), so that the entire feeding section 16 is supported by the support shaft 48. The support shaft 48 substantially extends from the widthwise center portion of the feeding tray 9 to the right end of the feeding tray 9. A large gear 49 is mounted to one end of the support shaft 48 at the widthwise outer end of the feeding tray 9, more concretely, slightly beyond the side end of the base plate 18. The large gear 49 is connected to an un-illustrated driving unit so that the support shaft 48 can be rotated by the power from the driving unit. A small gear 50 having substantially the same diameter as the support shaft 48 is mounted to the other end of the support shaft 48.

An arm member 53 for supporting the feeding roller 52 is mounted to the other end of the support shaft 48 at the widthwise center portion of the feeding tray 9. The arm member 53 has a pair of support arms 54, which extend outward in a diameter direction from the support shaft 48. The support arms 54 are spaced apart in the leftward and rightward directions and parallel to each other. The feeding roller 52 is fitted between the distal ends (pivoting ends) of the support arms 54. Since a rotation shaft of the feeding roller 52 is supported by bearing portions 55, which are formed in the support arms 54, the feeding roller 52 is held to be rotatable about an axis extending in the leftward and rightward directions. Four power transmission gears 56 are arranged between the pair of support arms 54 so that the power transmission gears 56 are sequentially meshed with one another in an extending direction of the support arms 54. The four power transmission gears 56 connect the small gear 50 of the support shaft 48 with a gear 52A of the feeding roller 52. If the support shaft 48 is rotated by the driving unit, the rotational force of the support shaft 48 is transmitted to the feeding roller 52 by way of the four power transmission gears 56. Among the four power transmission ear 56, the power transmission gear 56, which is directly meshed with the small gear 50, is so-called a one-way gear, which is configured to transmit the rotational force from the support shaft 48 to the feeding roller 52 and not to transmit the rotational force from the feeding roller 52 to the support shaft 48.

The arm member 53 can be pivoted between an inclined position at which the arm member 53 is inclined downward in the rearward direction and the rotation shaft of the feeding roller 52 is further lowered than the support shaft 48, and a horizontal position at which the rotation shaft of the feeding roller 52 is maintained at substantially the same height as the support shaft 48. When the arm member 53 is held at the horizontal position, most portions of the arm member 53 and the feeding roller 52 are placed in the frame 47. If the feeding tray 9 having a plurality of recording media accommodated therein is mounted to a normal mounting position in the tray receiving portion 10, the pivoting end of the arm member 53 is lowered due to its own weight such that the feeding roller 52 is placed on the upper surface of the uppermost recording medium. In this state, by rotating the feeding roller 52 in a counterclockwise direction of FIG. 2, the feeding roller 52 pushes rearward the recording media, the leading end of a recording medium is pressed against the guide plate 43 so that the single recording medium is separated from the other recording media, and the separated recording medium is conveyed into the free passage 15. A cork plate 57, which has a high frictional coefficient in comparison with the recording medium, is attached to the rear accommodation surface 19A of the feeding tray 9 at a position where the feeding roller 52 can be brought into contact with the cork plate 57 if no recording medium is accommodated in the feeding tray 9. Therefore, it is possible to easily feed the last single sheet of recording medium accommodated in the feeding tray 9, by means of the feeding roller 52.

A follower portion 61 is provided to the feeding section 16. When the feeding tray 9 is pulled and inserted from and into the apparatus body 3, the follower portion 61 cooperates with the cam portion 60 and the guide plate 43 to pivot the feeding roller 52 and the arm member 53. The follower portion 61 is integrated with one of the support arms 54 of the arm member 53 on the support shaft 48 side to extend from the lower end of the one support arm 54 along the support shaft 48. The follower portion 61 has a plate shape, which is flush with the lower surfaces of the support arms 54. With the feeding tray 9 mounted to the normal mounting position, the widthwise distal end of the follower portion 61, which is remote from the arm member 53, substantially extends up to a side end position of the feeding tray 9. Thus, the follower portion 61 is located on the guide wall 22 of the right side end guide 20R irrespective of a leftward and rightward position of the right side end guide 20R. The rear edge 61A of the follower portion 61 is slightly bent upward. A distance between the center of the support shaft 48 and the rear edge 61A is set to about half of a distance between the center of the support shaft 48 and the rotation shaft of the feeding roller 52. As will be described later, the lower surface of the follower portion 61 is brought into sliding contact with the cam portion 60 or the guide plate 43 and is displaced vertically when inserting and pulling the feeding tray 9 into and from the apparatus body 3, to pivot the arm member 53.

Figure 7:
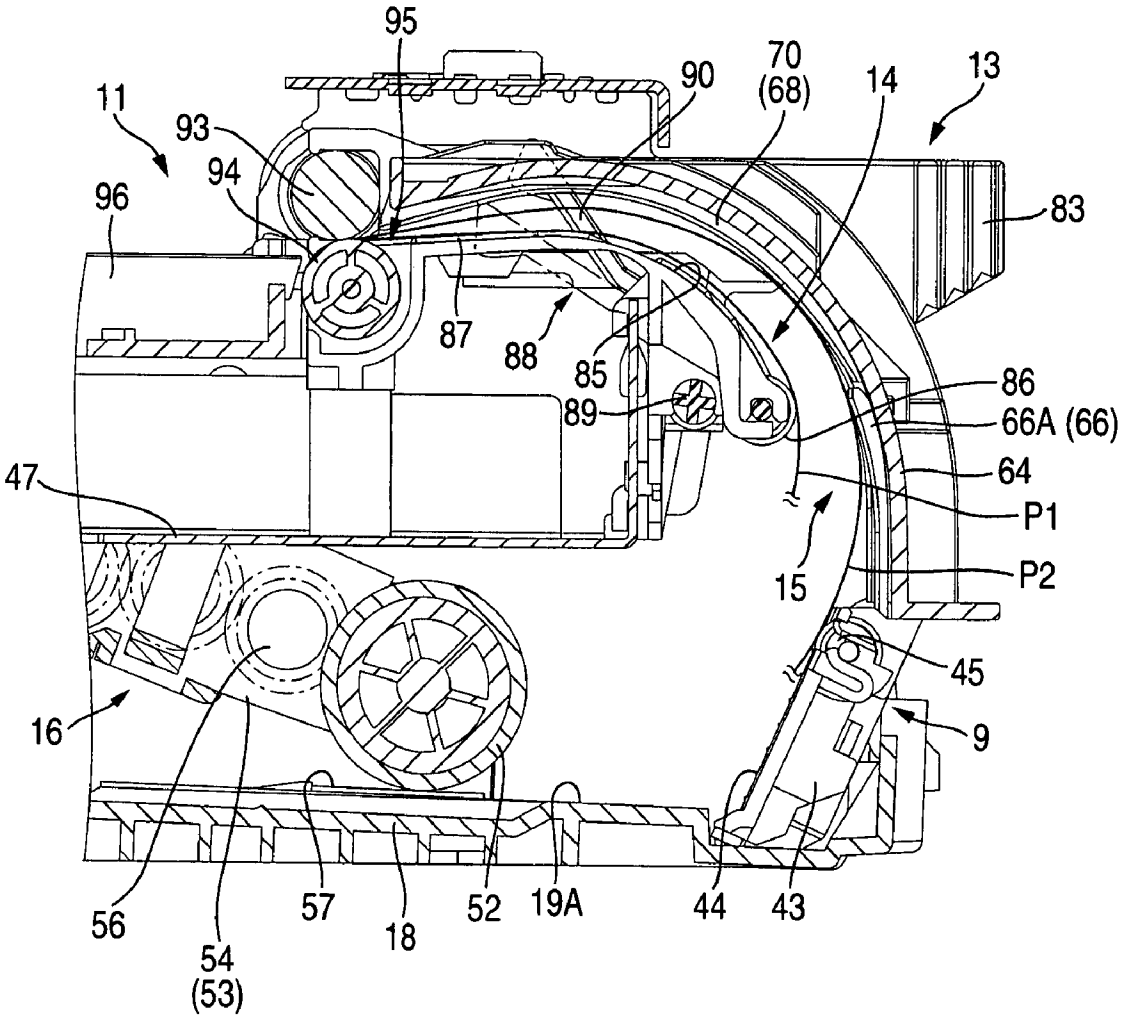
FIG. 7 is a partial enlarged sectional view illustrating the image recording apparatus according to the first embodiment of the present invention.
Figure 8:
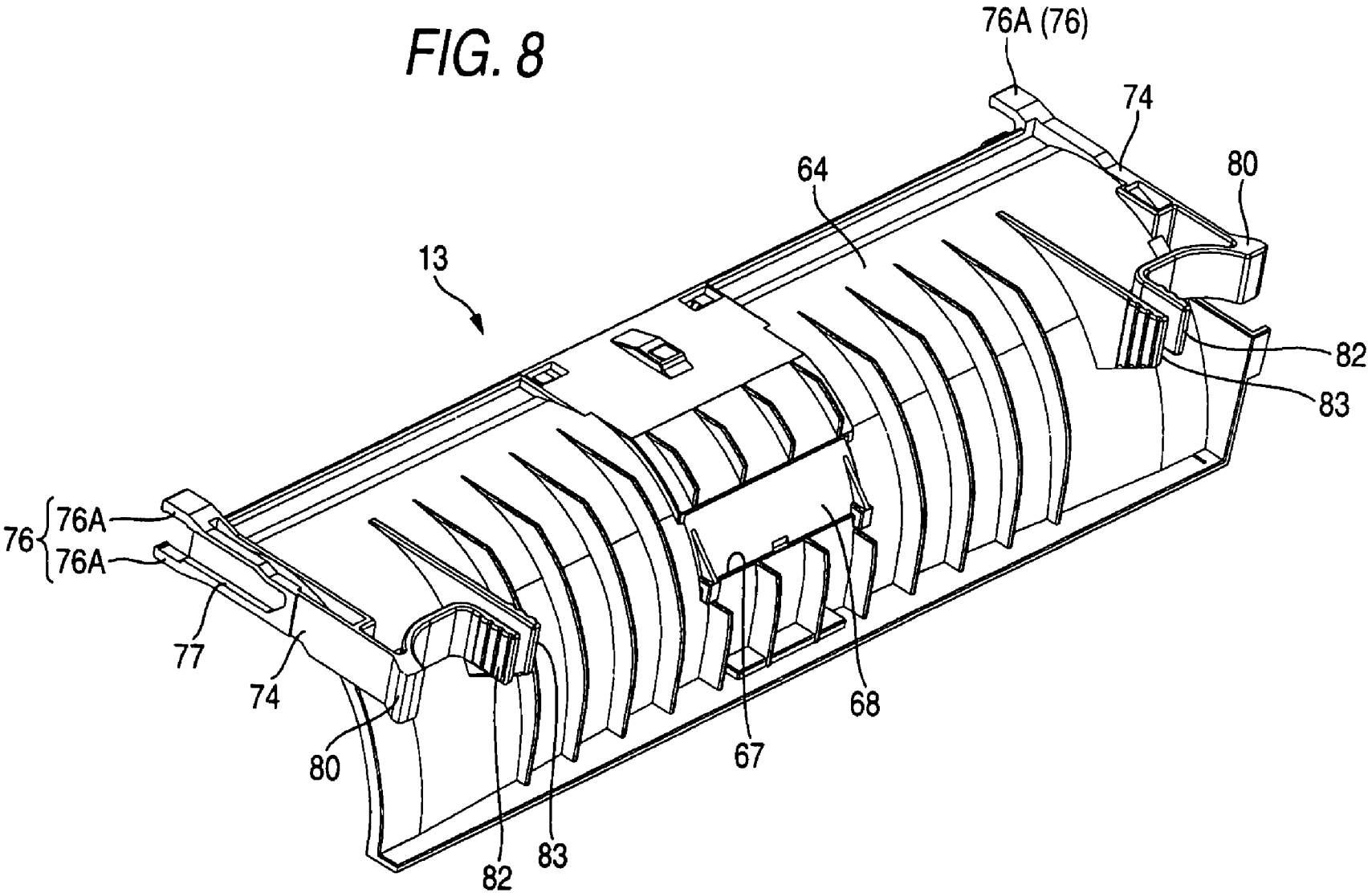
FIG. 8 is a rear perspective view of an outer arcuate guide member.
Figure 9:
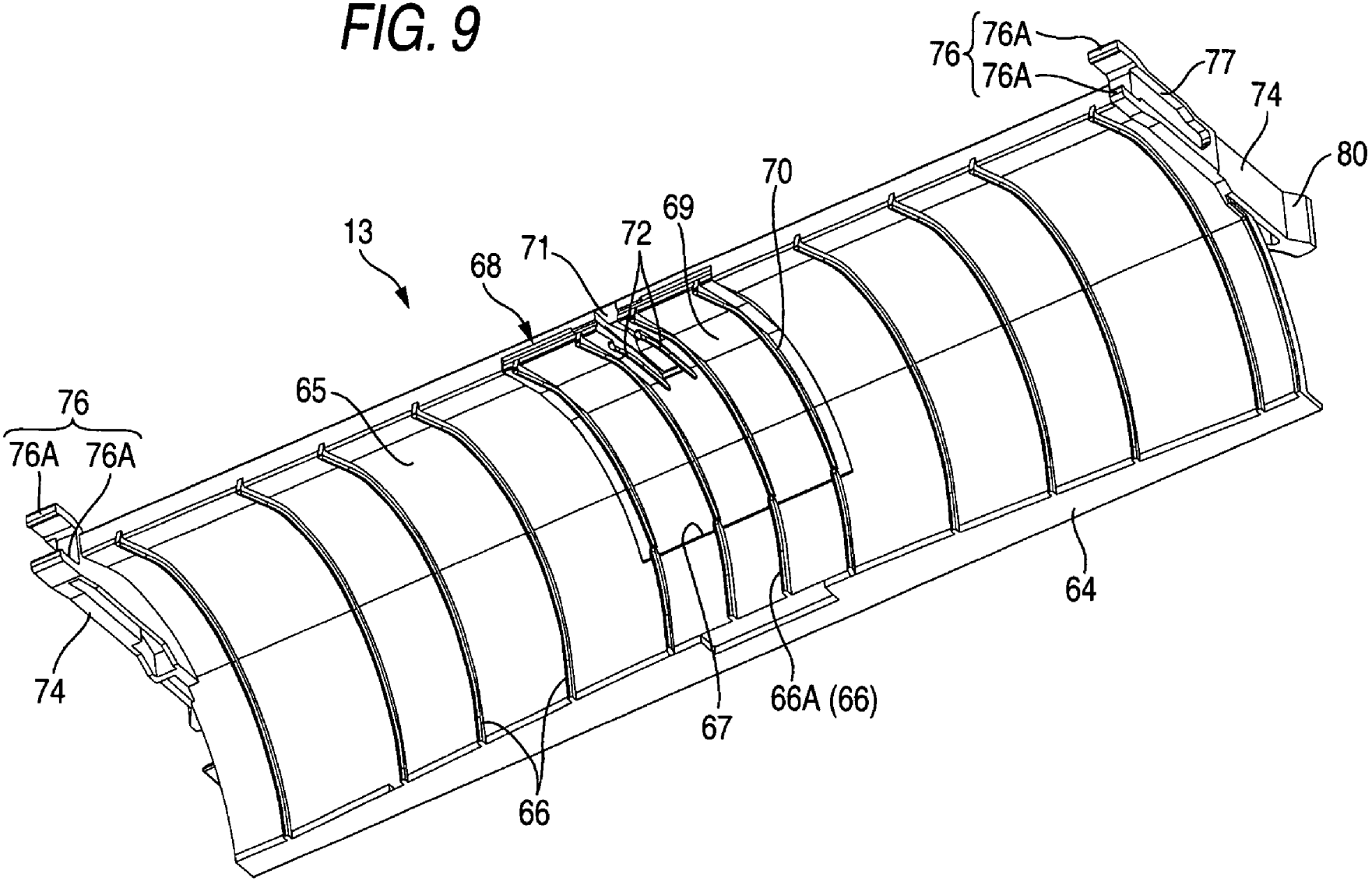
FIG. 9 is a front perspective view of the outer arcuate guide member.
Figure 10:
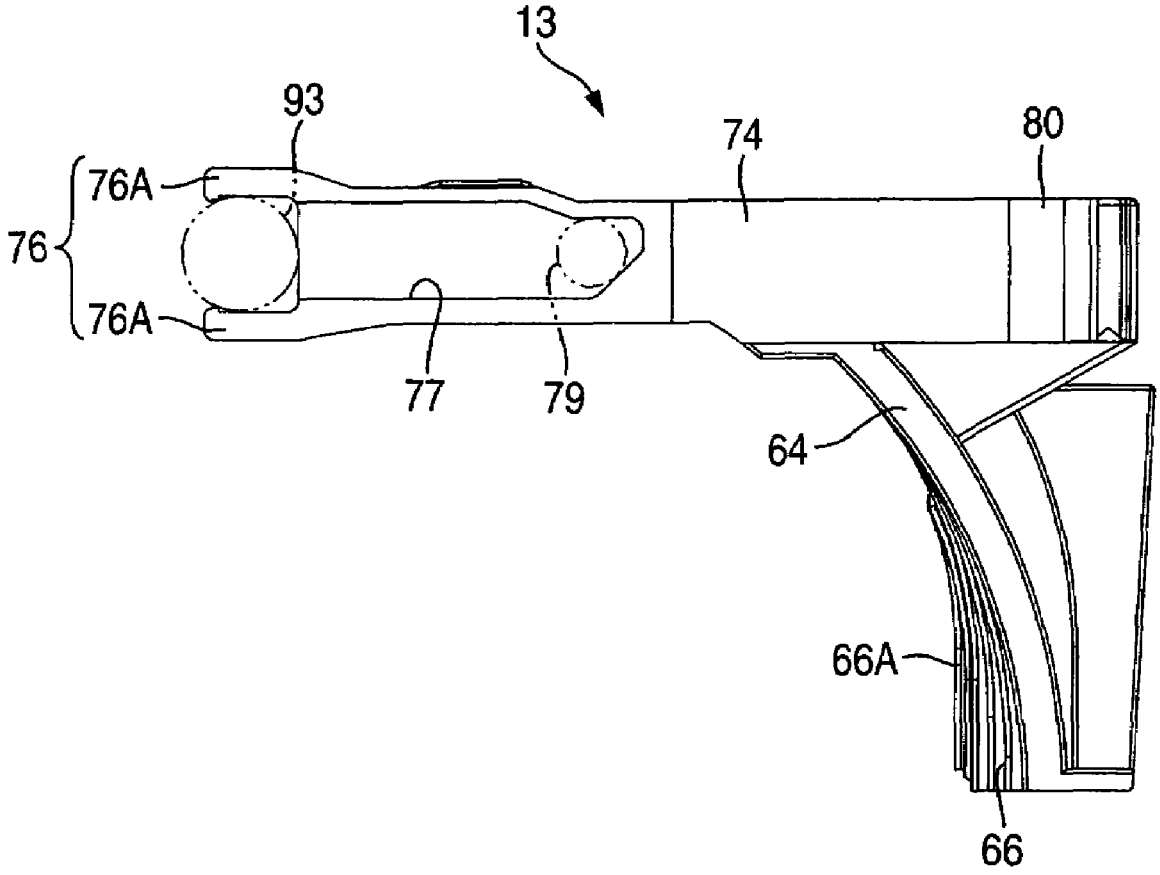
FIG. 10 is a side view of the outer arcuate guide member.
Figure 11:
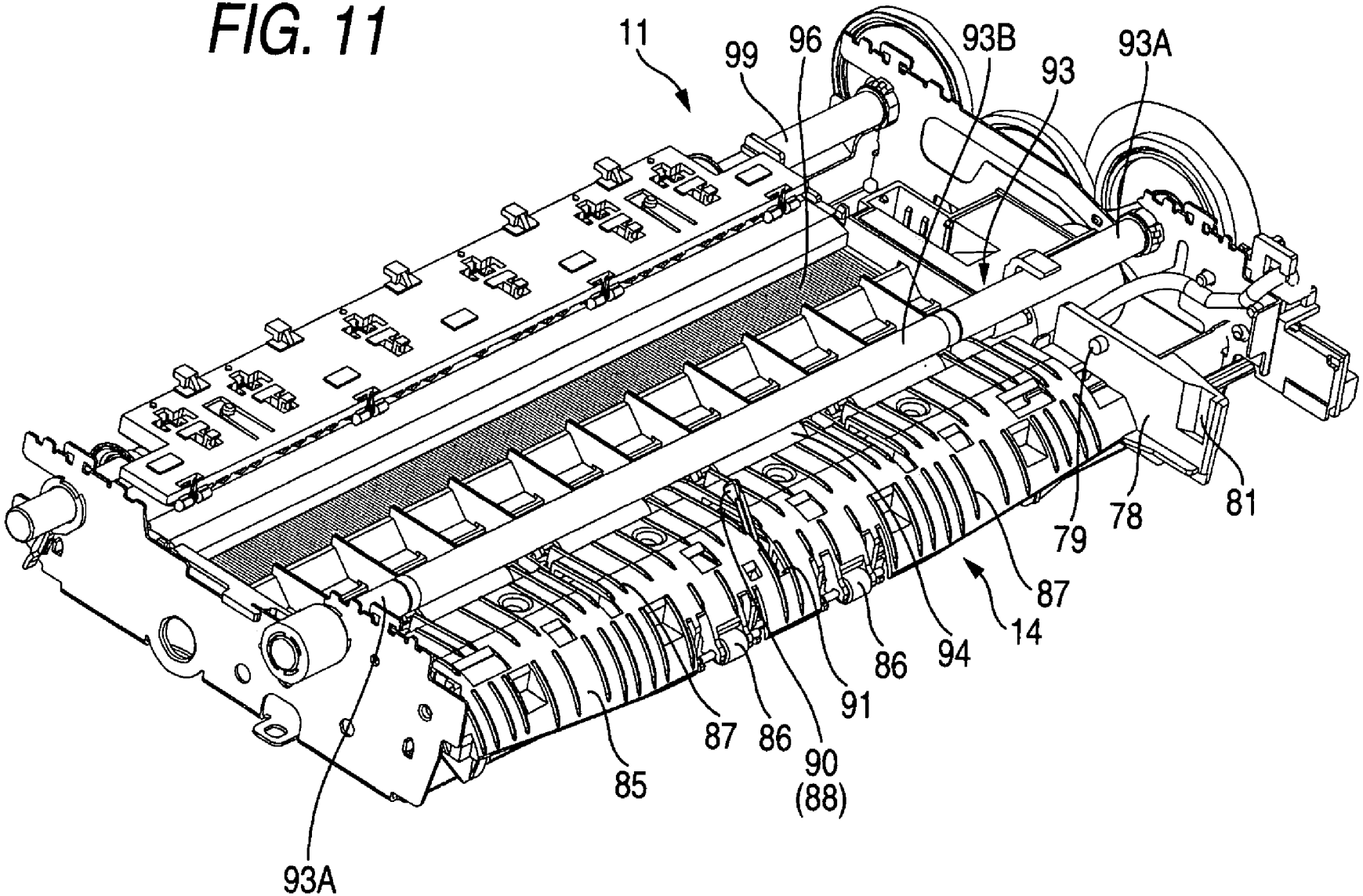
FIG. 11 is a perspective view illustrating a part of the image recording apparatus in a state where the outer arcuate guide member is dismounted.
Figure 12:
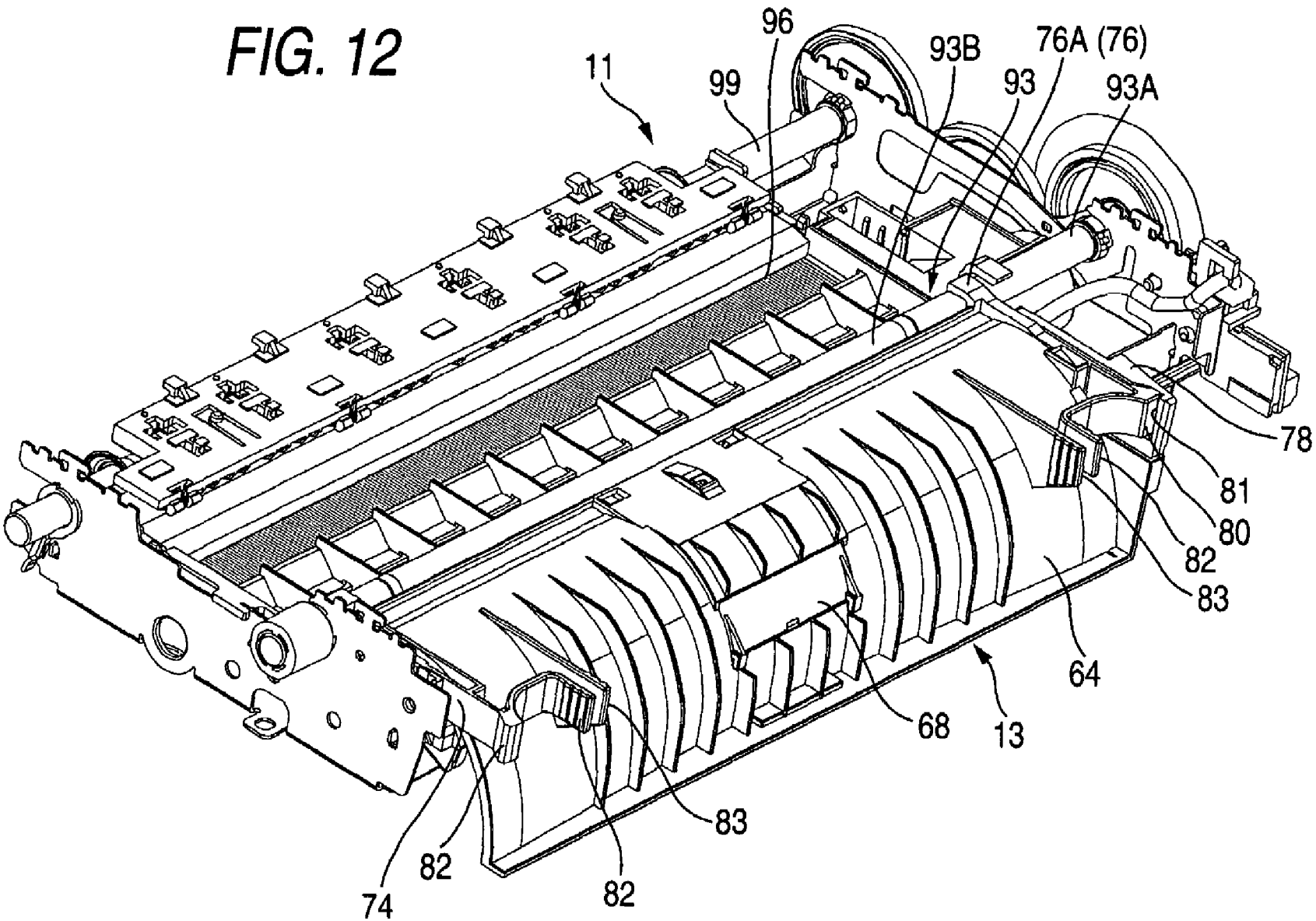
FIG. 12 is a perspective view illustrating the part of the image recording apparatus in a state where the outer arcuate guide member is mounted.

Next, the outer arcuate guide member 13 will be described with reference to FIGS. 7 through 12. FIG. 7 is a partial enlarged sectional view illustrating the image recording apparatus 1. FIG. 8 is a rear top perspective view of the outer arcuate guide member 13. FIG. 9 is a front bottom perspective view of the outer arcuate guide member 13. FIG. 10 is a side view of the outer arcuate guide member 13. FIG. 11 is a perspective view illustrating apart of the image recording apparatus 1 in a state where the outer arcuate guide member 13 is dismounted. FIG. 12 is a perspective view illustrating the part of the image recording apparatus 1 in a state where the outer arcuate guide member 13 is mounted.

The outer arcuate guide member 13 is mounted rearward of the image recording section 11 and upward of the rear end of the feeding tray 9. The outer arcuate guide member 13 can be dismounted through a mounting guide opening 63, which is defined in the rear wall of the casing 2 (see also FIG. 2). The outer arcuate guide member 13 as a whole is received in the casing 2. The rear end of the outer arcuate guide member 13 is located at substantially the same position as the rear wall of the casing 2. The outer arcuate guide member 13 has a body portion 64 which is curved along a widthwise direction thereof in an arc shape. The body portion 64 has an outer guide surface 65, which guides the recording medium and faces the free passage 15. The outer guide surface 65 is formed over substantially the same range as the feeding tray 9 in the widthwise direction. The upstream end of the outer guide surface 65 is located at the upper end of the guide plate 43. The downstream end of the outer guide surface 65 is located immediately before a regulation roller 93 and a driven roller 94, which define a recording medium insertion port 95 of the image recording section 11. The outer guide surface 65 extends substantially vertically at the upstream end portion thereof and is gradually inclined forward toward the downstream side of the conveyance direction. Then, after extending horizontally, the outer guide surface 65 is inclined downward toward the downstream end thereof. Therefore, the outer guide surface 65 defines a substantially arc-shaped contour. The outer guide surface 65 has a flat surface in the vicinity of the downstream end portion thereof. A plurality of ribs 66 project from the outer guide surface 65 to be spaced apart at regular intervals from one another in the widthwise direction and extend in the conveyance direction of the recording medium. In the vicinity of the upstream end portion of the outer guide surface 65, the widthwise center portion of the outer guide surface 65 projects toward the free passage 15. Due to this fact, the ribs 66A, which are located at the widthwise center portion of the outer guide surface 65, have larger overhanging dimension than that of the other ribs 66 at the other positions. In other words, tip ends of the ribs 66A, which are located at the widthwise center portion of the outer guide surface 65, are closer to an inner guide surface 85 of the inner arcuate guide member 14 than those of the other ribs 66 at the other positions.

At the widthwise center portion of the outer guide surface 65 and downstream of the projecting portion thereof, the body portion 64 defines an attachment depression 67. A resistance reducing portion 68 having a curved-plate shape is mounted to the attachment depression 67. The entire outer arcuate guide member 13 including the body portion 64 and the resistance reducing portion 68 is made of synthetic resin. The resistance reducing portion 68 is made of synthetic resin, which induces less friction resistance against the recording medium than that of the synthetic resin forming the other portion of the outer arcuate guide member 13. Specifically, the resistance reducing portion 68 is made of, for example, polyacetal (POM) resin, and the other portion of the outer arcuate guide member 13 is made of, for example, polystyrene (PS) resin. The surface of the resistance reducing portion 68 serves as a guide surface 69, which has a contour substantially similar to that of the outer guide surface 65 of the body portion 64. A plurality of ribs 70 project from the guide surface 69 to extend in the conveyance direction of the recording medium, so that the plurality of ribs 70 are connected with the ribs 66A formed on the projecting portion of the body portion 64. The ribs 70 of the resistance reducing portion 68 are formed in a manner such that the upstream ends of the ribs 70 have an overhanging dimension, which is slightly less than that of the ribs 66A of the body portion 64. In other words, the upstream ends of the ribs 70 are farther from the guide surface 85 of the inner arcuate guide member 14 than the tip ends of the ribs 66A. Therefore, the ribs 70 of the resistance reducing portion 68 are prevented from projecting into the free passage 15 beyond the ribs 66A of the body portion 64 due to forming errors, etc. Accordingly, the leading end of the recording medium is prevented from being caught by the ribs 70 of the resistance reducing portion 68. A detecting-piece receiving groove 71 is defined in the guide surface 69 of the resistance reducing portion 68 at a widthwise center position adjacent to the downstream end portion of the guide surface 69 so that a distal end of a detecting piece 90 contained in a regulation sensor 88 can be received in the detecting-piece receiving groove 71. The detecting-piece receiving groove 71 narrowly elongate in the conveyance direction of the recording medium. Auxiliary ribs 72 are formed on the guide surface 69 adjacent to both widthwise ends (opening edges) of the detecting-piece receiving groove 71 to have the substantially same overhanging dimension as the other ribs.

Side plate portions 74 are formed on the upper ends of the body portion 64 at both widthwise ends of the outer arcuate guide member 13 to extend in the forward and rearward directions. The front end position of the side plate portion 74 is substantially identical to the downstream end position on the outer guide surface 65. A positioning engagement portion 76 is formed at the front end of each side plate portion 74. The positioning engagement portion 76 has a pair of upper and lower engagement claws 76A which project forward. Each of rotation shafts 93A of the regulation roller 93 as will be described later can be fitted between the pair of engagement claws 76A of the positioning engagement portion 76.

A guide groove 77 is defined on each side plate portion 74 to extend rearward from a position between the pair of engagement claws 76A of the positioning engagement portion 76. On the other hand, a pair of side walls 78 are formed on the apparatus body 3 at both sides of the outer arcuate guide member 13 (see FIG. 11). While a left side wall 78 is not shown in FIG. 11, it should be understood that the left side wall 78 is in symmetrical with the right side wall 78. A guide protrusion 79 protrudes from each side wall 78 so that the guide protrusion 79 can be fitted in the guide groove 77. The guide protrusion 79 and the guide groove 77 function to guide the outer arcuate guide member 13 to the normal mounting position when mounting the outer arcuate guide member 13 to the apparatus body 3. The guide groove 77 is defined in a manner such that the entire portion of the guide groove 77, except for the terminal end, portion has a width, which is slightly greater than the outer diameter of the guide protrusion 79, and the terminal end portion of the guide groove 77 has a decreased width to allow the guide protrusion 79 to be tightly fitted therein.

A locking portion 80 is formed on the rear end of each side plate portion 74. The locking portion 80 can be bent and deformed in the leftward and rightward directions, and a distal end of the locking portion 80 projects outward. By engaging the distal end of the locking portion 80 into an engaged portion 81, which is formed on each side wall 78 in a recessed manner, the outer arcuate guide member 13 can be locked at the normal mounting position. A release operation portion 82 extends from the end portion of the locking portion 80. The release operation portion 82 is bent toward the inside of the widthwise direction of the outer arcuate guide member 13 to have a U-shaped section. With using the release operation portion 82, it is possible to displace the locking portion 80 in a direction where the locking portion 80 is disengaged from the engaged portion 81. A pair of left and right handle portions 83 are formed on the rear surface of the body portion 64. The distal end of each handle portion 83 is located at a predetermined separation from the end of the release operation portion 82 to face each other. By simultaneously holding the handle portions 83 and the release operation portions 82, the outer arcuate guide member 13 can be dismounted from the apparatus body 3.

The inner arcuate guide member 14 is located in the apparatus body 3 in a state where the inner arcuate guide member 14 is separated from the outer arcuate guide member 13 by a predetermined distance. The surface of the inner arcuate guide member 14, which faces the outer arcuate guide member 13, serves as an inner guide surface 85. The inner guide surface 85 has an upstream side (a rear portion), which has a greater curvature than that of the outer guide surface 65 of the outer arcuate guide member 13, and a downstream side (a front portion), which is substantially flat. The upstream end portion (the lower end portion) of the inner guide surface 85 is located upward of the upstream end of the outer guide surface 65. A pair of left and right auxiliary rollers 86 are rotatably mounted at the widthwise center portion of the inner guide surface 85. A plurality of ribs 87 project from the inner guide surface 85 to extend in the conveyance direction of the recording medium. The ribs 87 are divided into upstream side ribs and downstream side ribs and are spaced apart one from another at regular intervals in the widthwise direction.

As described above, the U-shaped free passage 15 is defined between the inner guide surface 85 of the inner arcuate guide member 14 and the outer guide surface 65 of the outer arcuate guide member 13. A distance between the guide surfaces 65 and 85 of the arcuate guide members 13 and 14 substantially increases in the upstream side of the conveyance direction (an entrance side of the free passage 15) and gradually decreases toward the downstream side of the conveyance direction. The distance between the guide surfaces 65 and 85 is set to be sufficiently large, except for the vicinity of the downstream end portion, in comparison with the thickness of the recording medium, so that the displacement of the recording medium in the thickness direction of the recording medium is allowed in the free passage 15. In the vicinity of the downstream end portion, the distance between the guide surfaces 65 and 85, strictly speaking, a distance between the distal ends of the ribs 66 and 87 of the guide surfaces 65 and 85 is set to be relatively small, so that the leading end of the recording medium exiting from the free passage 15 can be precisely positioned with respect to the insertion port 95, which is defined by the regulation roller 93 and the driven rollers 94. It is to be noted that, in the course of the free conveyance passage 15, which extends from the feeding roller 52 to the regulation roller 93, means for conveying a recording medium in a tightly sandwiched state, such as pinch rollers, are not provided.

The regulation sensor 88 for sensing the leading end and the trailing end of the recording medium is disposed on the lower side of the inner arcuate guide member 14 (on a side of a surface opposite to the inner guide surface 85) at a widthwise center position of the inner arcuate guide member 14. The regulation sensor 88 has the detecting piece 90, which can rotate about a mounting shaft 89 extending in the leftward and rightward directions. The detecting piece 90 is biased by a spring member (not shown) in a clockwise direction in FIG. 7. A through-hole 91 is defined at the widthwise center portion in the surface of the inner arcuate guide member 14, so that the distal end of the detecting piece 90 projects into the free passage 15 through the through-hole 91. In the case that the detecting piece 90 does not interfere with the recording medium in the free passage 15, the detecting piece 90 is received in the detecting-piece receiving groove 71 of the outer arcuate guide member 13, which is called a non-interference position (see the solid line in FIG. 7). On the other hand, in the case that the distal end of the detecting piece 90 interferes with the recording medium, the detecting piece 90 is retracted downward, which is called an interference position (see the two-dot chain line in FIG. 7). The regulation sensor 88 further has a photo-interrupter (not shown) for sensing a position of the detecting piece 90.

Hereafter, the image recording section 11 will be described with reference to FIGS. 2, 7 and 11. The regulation roller 93 (serving as a conveyance roller) is disposed at the upstream end portion (the rear end) of the image recording section 11 to extend in the leftward and rightward directions. The rotation shafts 93A, which are fixed to the apparatus body 3, are formed at both ends of the regulation roller 93. A rotating portion 93B, which can be rotated by power from the driving unit, is formed between the rotation shafts 93A. The plurality of driven rollers 94, which can be rotatingly driven by the regulation roller 93, are disposed below the rotating portion 93B of the regulation roller 93. The recording medium insertion port 95 is defined between the regulation roller 93 and the driven rollers 94, and the downstream end portion of the free passage 15 communicates with the recording medium insertion port 95.

A platen 96 is provided in the image recording section 11 downstream (forward) of the driven rollers 94 to support the recording medium from the bottom. A carriage 98, which is equipped with recording heads 97, is arranged above the image recording section 11. While the carriage 98 moves leftward and rightward over the platen 96, the recording heads 97 eject ink onto the recording medium placed on the platen 96 to record an image. The discharge roller 99, which extends in the leftward and rightward directions, is disposed downstream of the platen 96. The discharge roller 99 is rotatingly driven along with the regulation roller 93 to discharge the recording medium on which the image is recorded by the recording heads 97, onto the feeding tray 9.

Next, operation of the image recording apparatus 1 according to the first embodiment, constructed as mentioned above, will be described.

In the case of accommodating recording media in the feeding tray 9 inserted into the apparatus body 3, first, the feeding tray 9 is removed forward from the tray receiving portion 10. At this time, by inserting the fingers into the finger grip hole 40 of the auxiliary support member 39 received in the support member receiving space 38 and the second finger grip hole 41 of the base plate 10 and then grasping and pulling forward the auxiliary support member and the base plate 18, the feeding tray 9 can be easily removed from the apparatus body 3.

Here, in the case of removing the feeding tray 9 with recording media accommodated therein, it is necessary to release the recording media from the feeding roller 52, which is placed on the recording media. In this regard, if the rear accommodation surface 19A of the feeding tray 9 is a horizontal surface, since the feeding tray 9 is removed from the apparatus body 3, the recording media are likely to be caught by the feeding roller 52. On the contrary, in this embodiment, since the rear accommodation surface 19A of the feeding tray 9 is inclined downward in the downstream side (rear side) of the feeding direction of the recording medium, the feeding tray 9 can be removed from the apparatus body 3 in a state where the recording media are separated from the feeding roller 52 placed thereon in a downward direction. Accordingly, since the recording media are not caught by the feeding roller 52, it is possible to remove the feeding tray 9 smoothly.

Next, operation of the feeding section 16 when removing the feeding tray 9 will be described. When the feeding tray 9 is at the normal mounting position, the feeding roller 52 is brought into contact with the upper surface of a recording medium or the rear accommodation surface 19A of the base plate 18, and the follower portion 61 is held separated upward from the inclined surface 60A of the cam portion 60 (see FIG. 6A). In this state, if the feeding tray 9 is removed forward, the rear edge 61A of the follower portion 61 is brought into contact with the inclined surface 60B of the cam portion 60. Therefore, the rear edge 61A of the follower portion 61 is moved upward while sliding on the inclined surface 60B. As the rear edge 61A of the follower portion 61 is moved upward, the arm member 53 is pivoted in the counter clockwise direction in FIG. 6B. As a result, the feeding roller 52 is raised (see FIG. 6B). If the feeding tray 9 is further removed forward, the rear edge 61A of the follower portion 61 goes past the inclined surface 60B of the cam portion 60, the follower portion 61 runs on the horizontal portion 60C, and the arm member 53 assumes substantially horizontal posture (see FIG. 6C). Then, the feeding roller 52 is brought into contact with the upper end of the guide plate 43, and passes over the guide plate 43 while being rotated due to frictional contact with the guide plate 43. Since the feeding roller 52 passes over the guide plate 43, the upper end of the guide plate 43 is brought into contact with the lower surface of the arm member 53, and moves toward the support shaft 48 while being brought into sliding contact with the arm member 53 (see FIG. 6D). Thereafter, when the upper end of the guide plate 43 moves forward past the lower surface of the arm member 53, the feeding roller 52 is lowered due to its own weight (see FIG. 6E).

Therefore, since the cam portion 60 for raising the feeding roller 52 when removing or inserting the feeding tray 9 is provided to the right side end guide 20R, it is possible to omit a side wall portion of the feeding tray 9. As a result, a widthwise size of the feeding tray 9 can be reduced to contribute to the miniaturization of the image recording apparatus.

Further, since not only the movable side end guides 20R and 20L is provided to the feeding tray 9, but also the fixed side wall portions 32 are formed on the feeding tray 9 ahead of the side end guides 20R and 20L, the feeding tray 9 can be easily held in the hand. Also, because the fixed side wall portion 32 is flush with the side end guide 20R, a widthwise dimension of the feeding tray 9 does not increases.

After removing the feeding tray 9 from the apparatus body 3 in the above-described way, a user stacks recording media to be used, on the accommodation surfaces 19A and 19B. When recording media having an A4 size, a B5 size, and so forth are used, the recording media are inserted from the front part of the feeding tray 9 underneath the cover element 33 until they are brought into contact with the guide plate 43 positioned inside. At this time, since the cut-away portion 36 is defined on the cover element 33, even the recording media having a size smaller than the A4 size (for example, the B5 size) can be easily inserted into the inner side of the feeding tray 9. Also, in the case of using recording media having a postal card size or a standard L size which is smaller than the B5 size, by erecting the corresponding positioning rib 31, the recording media can be accommodated between the positioning rib 31 and the guide plate 43.

Subsequently, in the case that both side ends of the recording media are not brought into contact with the guide walls 22, positions of the side end guides 20R and 20L are adjusted in the leftward and rightward directions. Thereby, it is possible to bring the guide walls 22 to both side ends of the recording media. At this time, by moving the right side end guide 20R in the widthwise direction, the left side end guide 20L is also moved in an interlocked manner, whereby position adjusting operation for the side end guides 20R and 20L can be conveniently implemented. In this way, if the guide walls 22 are brought into contact with both side ends of the recording media in this way, the recording media are centrally positioned in the widthwise direction in the feeding tray 9.

Next, the feeding tray 9 having the recording media accommodated therein is inserted into the apparatus body 3. When horizontally inserting the feeding tray 9 into the tray receiving portion 10 from the front of the apparatus body 3, first, the upper end of the guide plate 43 is brought into contact with the follower portion 61 and the arm member 53, the follower portion 61 and the arm member 53 run on the guide plate 43, the feeding roller 52 is raised, and the arm member 53 is pivoted until the arm member 53 assumes a substantially horizontal posture (see FIG. 6D). In this state, when the feeding tray 9 is further inserted inward, the follower portion 61 runs on the horizontal portion 60C of the cam portion 60, and the feeding roller 52 is brought into contact with the upper end of the guide plate 43 and passes over the guide plate 43 (see FIG. 6C). Then, when the rear edge 61A of the follower portion 61 goes down along the inclined surface 60B of the cam portion 60, the feeding roller 52 is lowered (see FIG. 6B) to be brought into contact with the upper surface of recording media accommodated on the accommodation surfaces 19A and 19B, and the follower portion 61 is separated from the cam portion 60. Here, since the rear accommodation surface 19A of the feeding tray 9 is inclined downward in the downstream side (rear side) of the feeding direct ion of the recording medium, the recording media can be placed under the feeding roller 52 while pushing upward the feeding roller 52. Therefore, in comparison with the case where the accommodation surface for accommodating the recording media is a horizontal surface, the recording media are not caught by the feeding roller 52, whereby it is possible to prevent positional deviation of the recording media. When the feeding tray 9 is inserted to the normal mounting position (the position shown in FIG. 6A), mounting of the feeding tray 9 is completed.

Next, operations in a case of recording an image on a recording medium will be described.

First, the large gear 49 is rotated by power from the driving unit, and the rotational force of the large gear 49 is transmitted to the feeding roller 52 via the power transmission gears 56. Thereafter, when the feeding roller 52 is rotated in the counterclockwise direction of FIG. 7, the recording media on the accommodation surfaces 19A and 19B are fed rearward and pressed against the guide plate 43. Since the guide plate 43 is curved to project forward at the widthwise center portion thereof, the leading ends of the recording media pressed against the guide plate 43 are guided upward while being curved upward at their center portions. Then, the center portions of the leading ends of the recording media are brought into contact with the gear teeth of the separating member 44 provided at the projecting portion of the guide plate 43, and the uppermost single sheet of recording medium is separated. The recording medium guided upward in this way is conveyed upward into the free passage 15 while being brought into contact with the auxiliary rollers 45 respectively provided at the both sides of the separating member 44 on the upper end of the guide plate 43.

The leading end of the recording medium, which is conveyed upward from the guide plate 43, comes into contact with the vicinity of the upstream end portion of the outer guide surface 65 of the outer arcuate guide member 13. Here, among the plurality of ribs 66, the ribs 66A centrally located in the widthwise direction at the upstream end portion of the outer arcuate guide member 13 have larger overhanging dimension toward the free passage 15 than those of the other ribs 66. Therefore, the leading end of the recording medium, which is curved by the curved contour of the guide plate 43, is brought into contact with the ribs 66A at its widthwise center portion thereof, and both widthwise ends of the leading end of the recording medium are bent rearward. Consequently, due to the abutment between the leading end of the recording medium and the outer arcuate guide member 13, the widthwise center portion of the recording medium is prevented from being floating from the guide plate 43. As a result, it is possible to maintain the abutment between the recording medium and the auxiliary rollers 45.

In this way, the leading end of the recording medium conveyed into the free passage 15 is guided upward while being brought into sliding contact mainly with the central ribs 66A of the outer guide surface 65. Thereafter, the widthwise center portion of leading end of the recording medium comes into contact with the ribs 70 of the resistance reducing portion 68. When the widthwise center portion of leading end of the recording medium is guided to the downstream side of the conveyance direction while coming into sliding contact with the ribs 70 of the resistance reducing portion 68, both widthwise ends of the leading end of the recording medium are brought into sliding contact with the ribs 66 of the outer guide surface 65. Accordingly, while the posture of the leading end of the recording medium is gradually corrected, the recording medium is guided forward.

As described above, since the resistance reducing portion 68, which induces small friction resistance against the recording medium, is provided at the widthwise center portion of the outer arcuate guide member 13, the recording medium is prevented from being caught in the conveyance passage and can be smoothly conveyed to the downstream side of the conveyance direction. In the case that the entire outer arcuate guide member is made of only synthetic resin, which induces small friction resistance against the recording medium, it is difficult to accomplish required precision in molding, and a manufacturing cost increases. However, in this embodiment, since only the center portion of the outer arcuate guide member 13, which undergoes a large contact pressure, is made of synthetic resin having small contact resistance against the recording medium, it is possible to reduce friction resistance against the recording medium while preventing precision in molding from being degraded and the manufacturing cost from increasing.

If the leading end of the recording medium is brought into contact with the detecting piece 90 of the regulation sensor 88, which projects into the free passage 15, the detecting piece 90 is pressed by the recording medium to be retracted downward (to the interference position; see the two-dot chain line in FIG. 7), whereby reaching of the leading end of the recording medium to the position of the detecting piece 80 is sensed. Here, because the auxiliary ribs 72 project from the guide surface 69 adjacent to the opening edges on both sides of the detecting-piece receiving groove 71, the recording medium, which is pressed by the biasing force of the detecting piece 90, is supported by the pair of auxiliary ribs 72, which are arranged opposite the detecting piece 90. Therefore, the recording medium is prevented from being introduced into the detecting-piece receiving groove 71. As a result, since it is possible to sufficiently secure a displacement distance between interference position and the non-interference position of the detecting piece 90, precision for sensing the recording medium can be improved.

The leading end of the recording medium, which have passed the position where it is brought into contact with the detecting piece 90, exits from the free passage 15 and reaches the recording medium insertion port 95, which is defined between the regulation roller 93 and the driven rollers 94. Here, since the downstream end portion of the outer guide surface 65 of the outer arcuate guide member 13 has the flat surface, the leading end of the recording medium is precisely directed to the recording medium insertion port 95.

At the time point where the leading end of the recording medium is sensed by the regulation sensor 88, the regulation roller 93 is rotatingly driven in a backward direction (the counterclockwise direction in FIG. 7). Then, after a predetermined time is lapsed, the regulation roller 93 is controlled to be rotated in a forward direction (the clockwise direction in FIG. 7). At the time when the leading end of the recording medium reaches the recording medium insertion port 95 defined between the rollers 93 and 94, since the regulation roller 93 is rotated in the backward direction, the recording medium cannot be introduced between the rollers 93 and 94, and instead, is adjusted in its skew.

Thereafter, if the regulation roller 93 is rotated in the forward direction at predetermined timing, the leading end of the recording medium is nipped by the rollers 93 and 94 and pulled forward. Here, in the case that the recording medium is made of material having relatively high flexibility (for example, thin printing paper, OHP sheet, etc.). If the leading end of the recording medium is pulled forward, the recording medium assuming a posture, which conforms to the ribs 66 and 70 of the outer arcuate guide member 13, is displaced toward the inner arcuate guide member 14 to assume a posture which conforms to the inner guide surface 85, as shown by P1 in FIG. 7. In this state, if the regulation roller 93 is rotated, the recording medium P1 is conveyed to the downstream side in the conveyance direction by the auxiliary rollers 86, and then, is introduced into the recording medium insertion port 95 while being brought into sliding contact with the ribs 87 of the inner guide surface 85.

Meanwhile, in the case that the recording medium is made of material having relatively low flexibility (for example, thick paper, postal card, etc.), if the leading end of the recording medium is pulled forward by the regulation roller 93, although the recording medium tries to displace toward the inner arcuate guide member 14, the recording medium does not assume a posture which, conforms to the inner guide surface 85, and instead, as shown by P2 in FIG. 7, is displaced to be more close to the outer arcuate guide member 13 than the case of the above-described recording medium P1. In other words, in the free passage 15, the recording medium P2 made of material having low flexibility assumes a posture, which is curved to a degree less than the recording medium P1 made of material having high flexibility. Further, in this state, if the regulation roller 93 is rotated, the recording medium P2 is introduced into the recording medium insertion port 95 while freely assuming a posture in the free passage 15 depending upon various conditions such as a tensile force applied from the regulation roller 93, flexibility of the recording medium P2, and so on.

Here, if the recording medium is always conveyed in the passage while assuming a uniform (curved) posture, when a tensile force or a drawing force is applied to the recording medium from the conveyance unit including the regulation roller and driven rollers, the recording medium is likely to be pulled or bent forcibly. As a result, an excessive load may be applied to the conveyance unit. However, in this embodiment, since the free passage 15 is defined between the outer arcuate guide member 13 and the inner arcuate guide member 14 to allow displacement of the recording medium in the thickness direction thereof, freedom is rendered in the posture of the recording medium. Therefore, it is possible to decrease a load applied to the conveyance unit, and the recording medium can be conveyed smoothly without using pinch rollers.

If the recording medium having passed through the recording medium insertion port 95 in this way is conveyed onto the platen 96 through rotation of the regulation roller 93, a desired image is recorded on the recording medium placed on the platen 96 by the recording heads 97. Then, the recording medium having passed over the platen 96 is conveyed forward by the discharge roller 99 and then discharged onto the overhanging portions 28 and the cover element 33 of the feeding tray 9. Since the feeding tray 9 also serves as a discharge tray for receiving the recording medium discharged from the image recording section 11, the entire image recording apparatus can have a compact configuration. Further, because the cover element 33 and the overhanging portion 28 are inclined downward in the rearward direction, the recording medium discharged onto the cover element 33 and the overhanging portion 26 is prevented from falling.

Also, when it is necessary to record an image on a recording medium having a dimension such as the A4 size, which is greater than the combined length of the cover element 33 and the overhanging portion 28, the auxiliary support member 39 is extended forward, an end portion of the recording medium, which droops from the front end of the cover element 33, can be supported by the auxiliary support member 39, whereby the recording medium is prevented from falling. When not in use, the auxiliary support member 39 can be retracted into the support member receiving space 38 not to hinder activities of the user. Also, when the discharged recording medium is small not to get out of the front end of the cover element 33, the recording medium can be pulled out easily by grasping the end portion of the recording medium from up and down using the cut-away portion 36 defined on the cover element 33 without extracting the feeding tray 9 from the apparatus body 3.

Next, a sequence for attaching and detaching the outer arcuate guide member to and from the apparatus body 3 to deal with a jammed state will be described. In order to detach the outer arcuate guide member 13, first, the left and right release operation portions 82 and the left and right handle portions 83, which are formed on the outer (rear) surface of the outer arcuate guide member 13, are simultaneously grasped by hands through the mounting guide opening 63, and then, the release operation portions 82 are pressed against the handle portions 83. By doing this, the locking portions 80 are bent inward in the widthwise direction and disengaged from the engaged portions 81. Then, in a state in which the release operation portions 82 and the handle portions 83 are grasped as they are, the release operation portions 82 and the handle portions 83 are pulled rearward. In this way, the engagement of the positioning engagement portions 76 with the rotation shafts 93A of the regulation roller 93 is released. In this state, by further pulling rearward the outer arcuate guide member 13, the guide protrusions 79 are removed from the guide grooves 77. As a result, the outer arcuate guide member 13 is detached. When the outer arcuate guide member 13 is detached from the apparatus body 3, one side of the free passage 15 is opened to the outside. In this regard, since members for tightly sandwiching the recording medium, such as pinch rollers are not provided in the free passage 15, the jammed recording medium can be simply removed.

In the case of attaching the detached outer arcuate guide member 13 to the apparatus body 13, the left and right release operation portions 82 and the left and right handle portions 83 are simultaneously grasped by hands. Then, while the release operation portions 82 are pressed against the handle portions 83, the outer arcuate guide member 13 is inserted from the rear through the mounting guide opening 63 into the apparatus body 3. Therefore, since the guide protrusions 79 are respectively fitted into the guide grooves 77 to guide the forward movement of the outer arcuate guide member 13, the outer arcuate guide member 13 is prevented from leaning aside. When the outer arcuate guide member 13 approaches the normal mounting position, each of the rotation shafts 93A of the regulation roller 93 elastically deforms the pair of engagement claws 76A of each positioning engagement portion 76 outwardly, and then, is firmly fitted between the engagement claws 76A. As a result, by freeing the hands from the release operation portions 82 and the handle portions 83, the release operation portions 82 are returned to their original positions, and the locking portions 80 are engaged into the engaged portions 81. In this way, the outer arcuate guide member 13 is locked to the normal mounting position.

As described above, by simultaneously grasping the release operation portions 82 and the handle portions 83, engagement and disengagement operation for the locking portions 80 and the attachment and detachment operation for the outer arcuate guide member 13 can be simultaneously performed. Therefore, the operation can be easily and conveniently conducted.

Also, because the positioning engagement portions 76 of the outer arcuate guide member 13 can be engaged with the rotation shafts 93A of the regulation roller 93, positioning accuracy of the outer arcuate guide member 13 with respect to the regulation roller 93 can be improved. Accordingly, it is possible to precisely guide the leading end of the recording medium to the position to be bit with the regulation roller 93.

As apparent from the above description, according to this embodiment, since the tree passage 15 is defined between the outer arcuate guide member 13 and the inner arcuate guide member 14 to allow displacement of the recording medium in the thickness direction thereof, freedom is rendered in the posture of the recording medium, which is conveyed, and it is possible to reliably convey the recording medium without using pinch rollers. As a result, since a configuration of the image recording apparatus 1 is simplified, it is possible to miniaturize the image recording apparatus 1 and reduce the manufacturing cost.

Also, because the outer arcuate guide member 13 can be attached and detached to and from the apparatus body 3 from the outside of the casing 2 of the image recording apparatus 1, it is possible to easily deal with a jammed state.

Further, when mounting the outer arcuate guide member 13, because the guide protrusions 79 are respectively fitted into the guide grooves 77 of the outer arcuate guide member 13 to guide the outer arcuate guide member 13 to the normal mounting position, the mounting operation can be conveniently performed.

Moreover, since the positioning engagement portions 76 of the outer arcuate guide member 13 can be engaged with the rotation shafts 93A of the regulation roller 93, positioning accuracy of the outer arcuate guide member 13 with respect to the regulation roller 93 can be improved. Therefore, the leading end of the recording medium is precisely guided to the recording medium insertion port 95.

Furthermore, by simultaneously grasping the release operation portions 82 of the outer arcuate guide member 13 and the handle portions 83, engagement and disengagement operation for the locking portions 80 and the attachment and detachment operation for the outer arcuate guide member 13 can be simultaneously performed. Therefore, the operation can be easily and conveniently conducted.

In addition, since the position of the outer (rear) end of the outer arcuate guide member 13 is substantially identical to that of the rear wall of the casing 2, a turning position of the recording medium in the conveyance passage is close to an end surface of the casing 2. Therefore, it is possible to miniaturize the casing 2.

Besides, since the plurality of ribs 66 project from the outer guide surface 65 of the outer arcuate guide member 13, friction resistance against the recording medium is reduced. Therefore, it is possible to reliably convey the recording medium.

Also, because the central ribs 66A are mainly brought into contact with the recording medium among the plurality of ribs 66 and the other ribs 66 are not much brought into contact with the recording medium, it is possible to reliably convey the recording medium.

Further, since the resistance reducing portion 68, which induces small friction resistance against the recording medium, is provided at the widthwise center portion of the outer arcuate guide member 13, the recording medium is prevented from being caught in the conveyance passage and can be reliably conveyed to the downstream side of the conveyance direction. In the case that the entire outer arcuate guide member is made of only synthetic resin, which induces small friction resistance against the recording medium, it is difficult to accomplish required precision in molding, and the manufacturing cost increases. However, in this embodiment, since only the center portion of the recording medium, which undergoes a large contact pressure of the recording medium, is made of synthetic resin having small contact resistance against the recording medium, it is possible to reduce friction resistance against the recording medium, while preventing precision in molding from being degraded and the manufacturing cost from increasing.

Moreover, since the auxiliary rollers 86 are rotatably mounted to the upstream end portion of the inner arcuate guide member 14 in the conveyance direction of the recording medium, the recording medium is prevented from being caught by the end portion of the inner arcuate guide member and can be reliably conveyed in the conveyance direction.

Since the guide plate 43 is provided on the feeding tray 9, the leading end of the recording medium fed by the feeding section 16 can be reliably guided upward and conveyed to the free passage 15 side.

Because the separating member 44 is provided at the forward projecting portion of the guide plate 43, the recording media pressed against the guide plate 43 can abut against the separating matter 44 and be separated reliably.

Also, since the auxiliary rollers 45 are respectively provided on the both sides of the separating member 44 in the widthwise direction, the recording medium separated by the separating member 44 can be reliably conveyed in a state where the recording medium is brought into contact with the auxiliary rollers 45.

Next, a second embodiment of the present invention will be described with reference to FIGS. 13 through 26.

In the following description, the same component elements as in the first embodiment will be designated by the same reference numerals, and detailed description thereof will be omitted.

Figure 13:
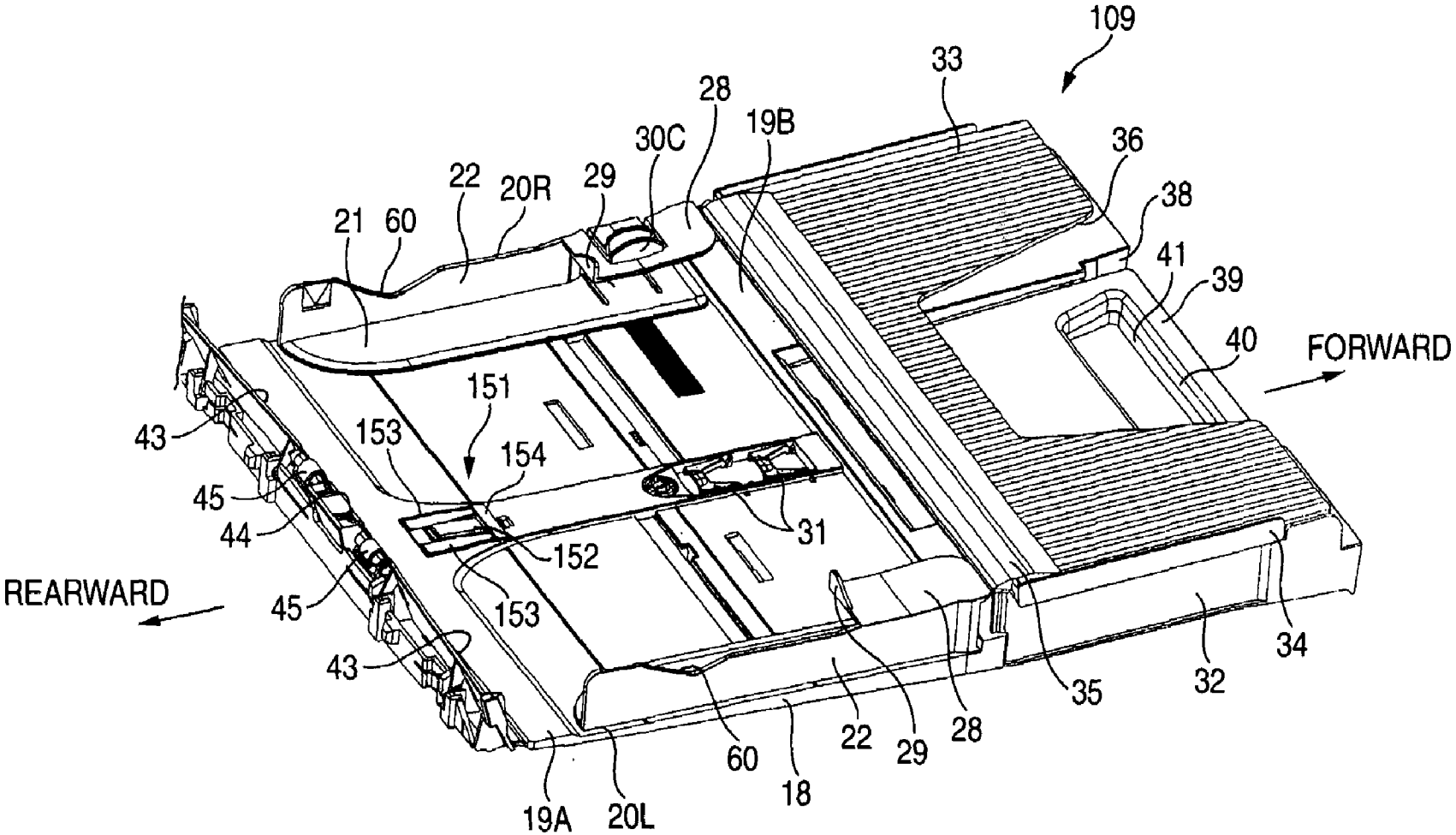
FIG. 13 is a perspective view illustrating a feeding tray in accordance with a second embodiment of the present invention.
Figure 14:
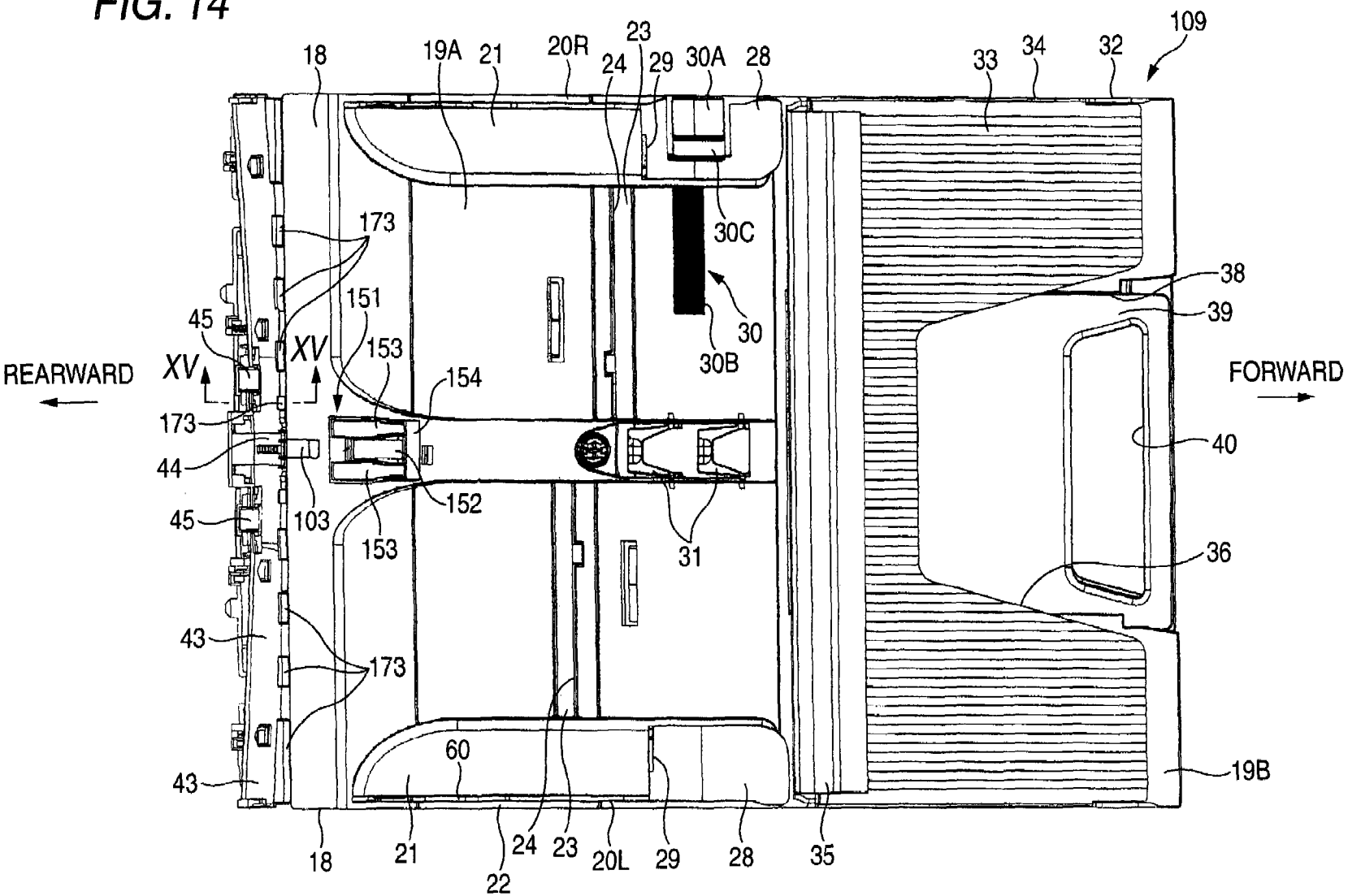
FIG. 14 is a plan view of the feeding tray.
Figure 15:
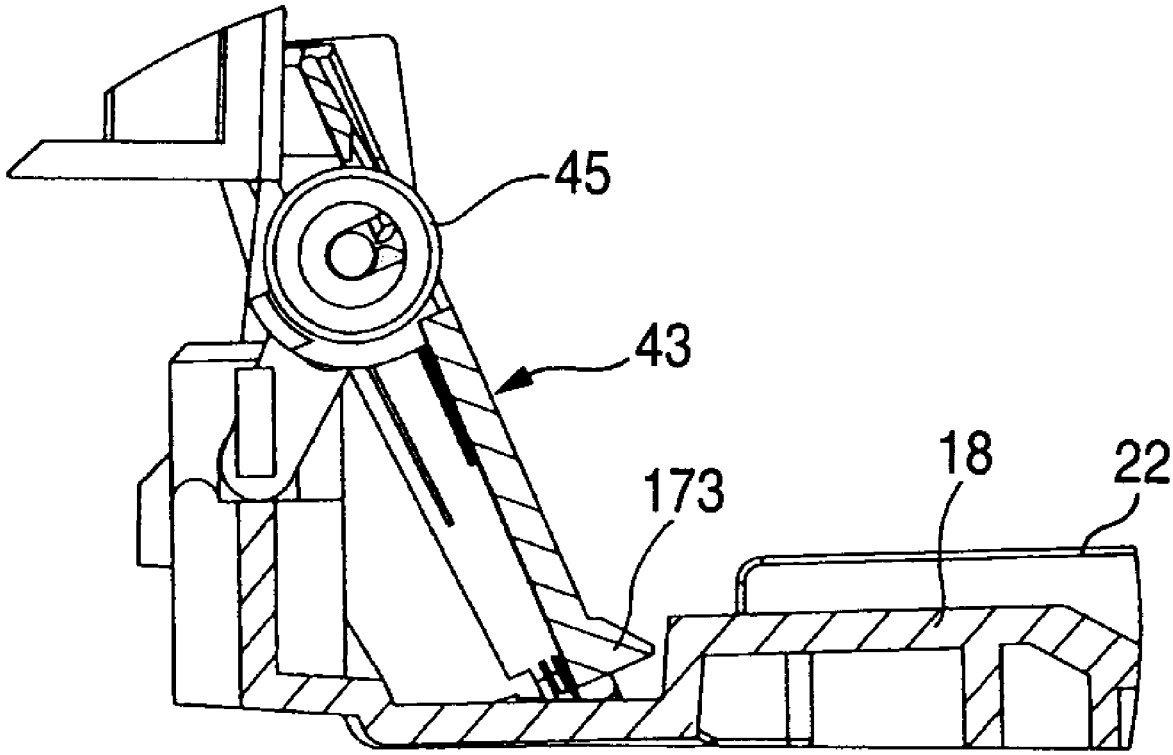
FIG. 15 is a sectional view taken along the line XV-XV of FIG. 14.

First, a feeding tray 109 will be described with reference to FIGS. 13 through 15. FIG. 13 is a perspective view illustrating the feeding tray 109 in accordance with the second embodiment. FIG. 14 is a plan view of the feeding tray 109. FIG. 15 is a sectional view taken along the line XV-XV of FIG. 14.

The feeding tray 109 has an overlapped conveyance-prevention portion 151 in place of the cork plate 57 of the first embodiment. The overlapped conveyance-prevention portion 151 has a cork plate 152, which is placed on the base plate 18 of the feeding tray 109 to face the feeding roller 52 and serves as a high friction member, and metal plates 153, which are made of stainless steel to serve as a low friction member. The overlapped conveyance-prevention portion 151 is located at a position where the feeding roller 52 can be brought into contact with the overlapped conveyance-prevention portion 151 in a state where no recording medium is accommodated in the feeding tray 109. With this configuration, it is possible to easily feed the last single sheet of recording medium accommodated in the feeding tray 109, using the feeding roller 52.

The cork plate 152 and the metal plates 153 are arranged in a direction perpendicular to a feeding direction of the recording medium. A jump board 154 is projectedly integrated with the base plate 18 so that a downstream side of the jump board 154 in the feeding direction is higher than an upstream side of the jump board 154 in the feeding direction. Preferably, the metal plates 153 are respectively placed on both sides of the cork plate 152 so as to be adjacent to the downstream side end of the jump board 154 in the feeding direction. The two metal plates 153 are fixed to the upper surface of the base plate 18 by an adhesive or the like. Between the pair of metal plates 153, an opening (not shown) is defined in the base plate 18. The cork plate 152 is fixed by an adhesive to the upper surface of a base spring (not shown), which serves as a support element and is disposed in the opening.

Since the metal plates 153 serving as the low friction member is made of a metallic material such as stainless steel, wear resistance is high and a frictional coefficient of the surface thereof is held low. Therefore, in comparison with the case of using the base plate 18 made of synthetic resin as a low friction member, it is possible to reliably feed the last single sheet of recording medium.

An upward guiding portion 103 is integrally formed on the surface of the base plate 18 between the cork plate 152 and the lower end of the guide plate 43. The upward guiding portion 103 has an inclined surface, which is low at the upstream side of the feeding direction of the recording medium and is gradually increased in its height toward the downstream side of the feeding direction (see FIG. 14). With this configuration, even when the number of recording media accommodated in the feeding tray 109 decreases, a leading end of the recording medium, which is fed by the feeding roller 52, is brought into contact with the guide plate 43 at a position, which is higher than the lower end of the guide plate 43. Therefore, the recording medium can be reliably fed upward. Also, an upper end of the upward guiding portion 103 may have a flat portion, which is parallel to the surface of the base plate 18 and extends toward the lower end of the guide plate 43.

As shown FIG. 15, a plurality of auxiliary ribs 173 are integrally formed on the lower end of the guide plate 43. The auxiliary ribs 173 are spaced apart at regular intervals in the widthwise direction and have a predetermined length in the widthwise direction and a substantially triangular sectional shape. Since the guide plate 43 has a curved contour as aforementioned above, a gap is created between the rear edge of the base plate 18 of the feeding tray 109 and the lower end of the guide plate 43. The auxiliary ribs 173 are formed to fill this gap. Due to the presence of the auxiliary ribs 173, when the number of recording media accommodated in the feeding tray 109 decreases and the recording medium adjacent to the base plate 18 is conveyed, the leading end of the recording medium is prevented from being caught in the gap. Therefore, the recording medium can be reliably guided upward of the guide plate 43.

Hereafter, an outer arcuate guide member 113 of the second embodiment will be described with reference to FIGS. 16 through 23. Since the inner arcuate guide member 14 is configured in the same manner as the first embodiment, description thereof will be omitted.

Figure 16:
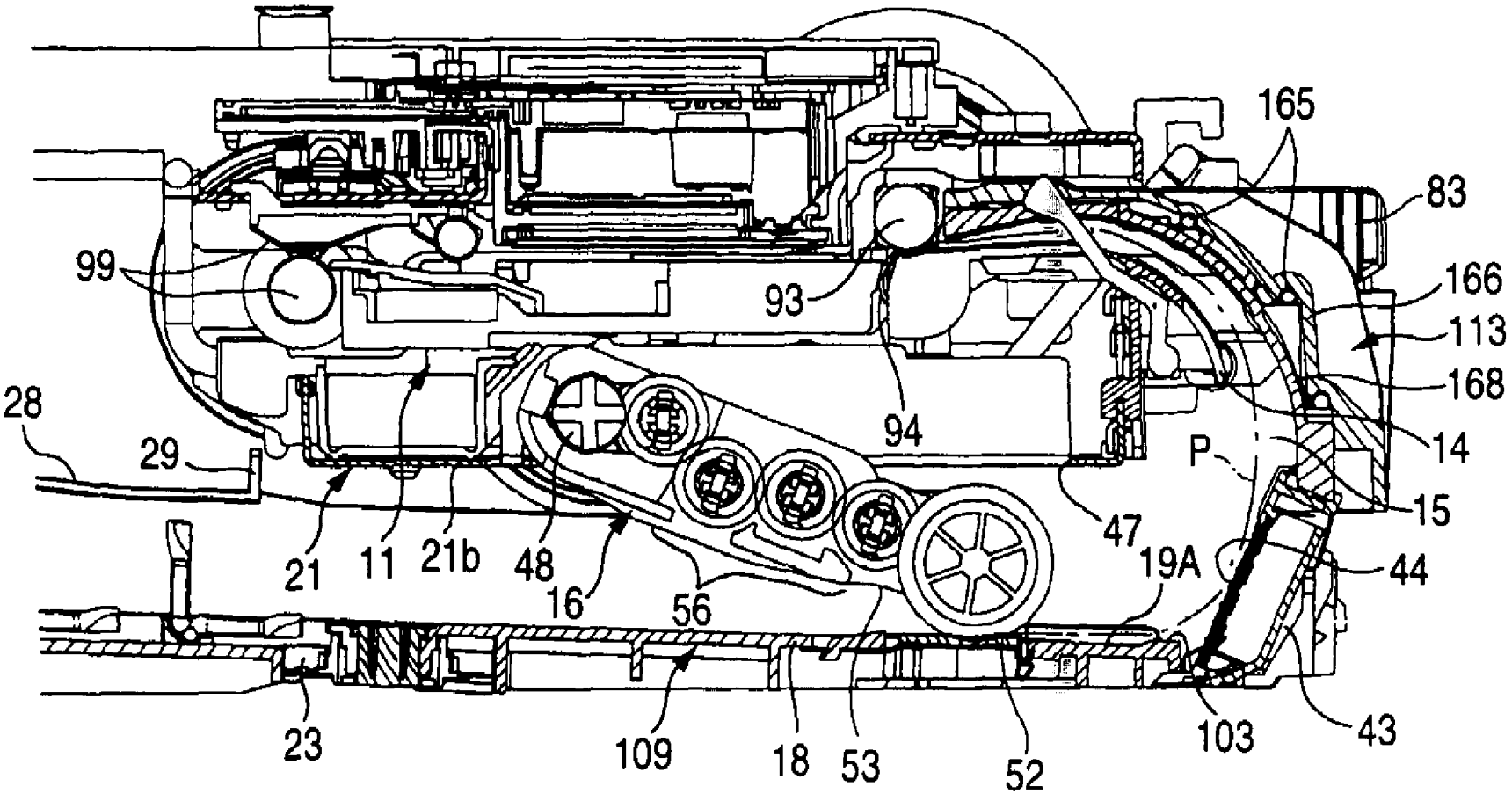
FIG. 16 is a partial enlarged sectional view illustrating an image recording apparatus according to the second embodiment of the present invention.
Figure 17:
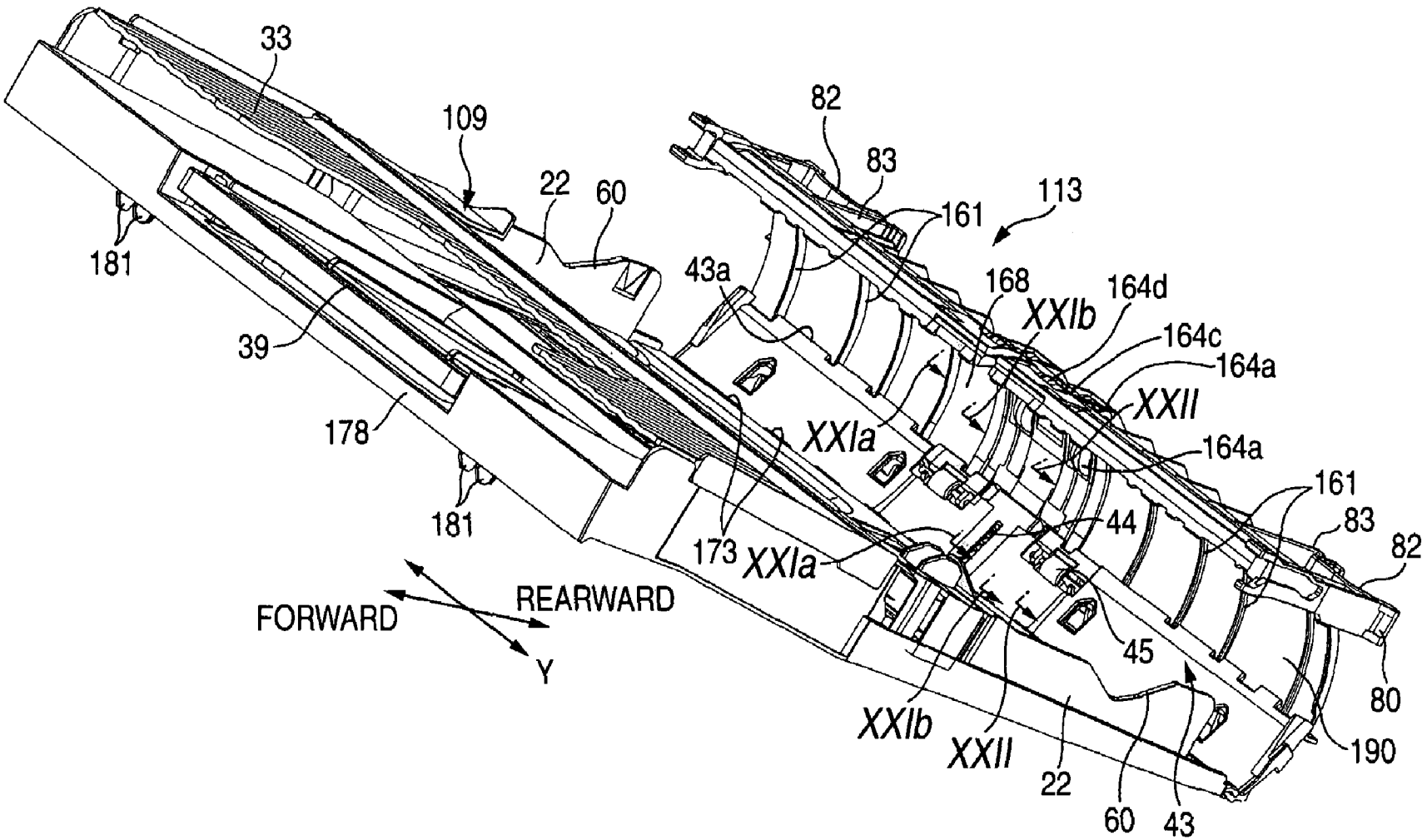
FIG. 17 is a perspective view illustrating a feeding tray and an outer arcuate guide member.
Figure 18:
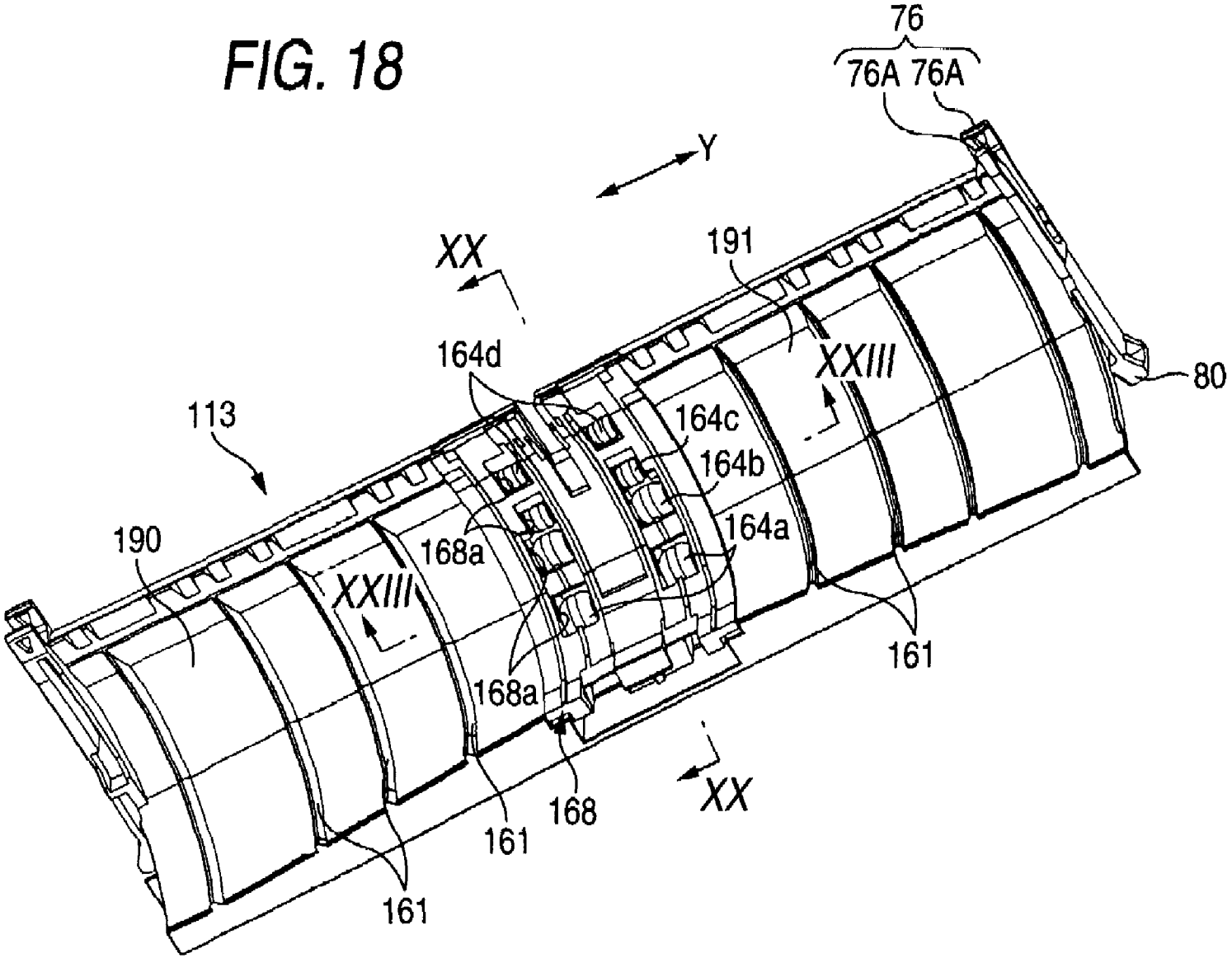
FIG. 18 is a front perspective view illustrating the outer arcuate guide member.
Figure 19:
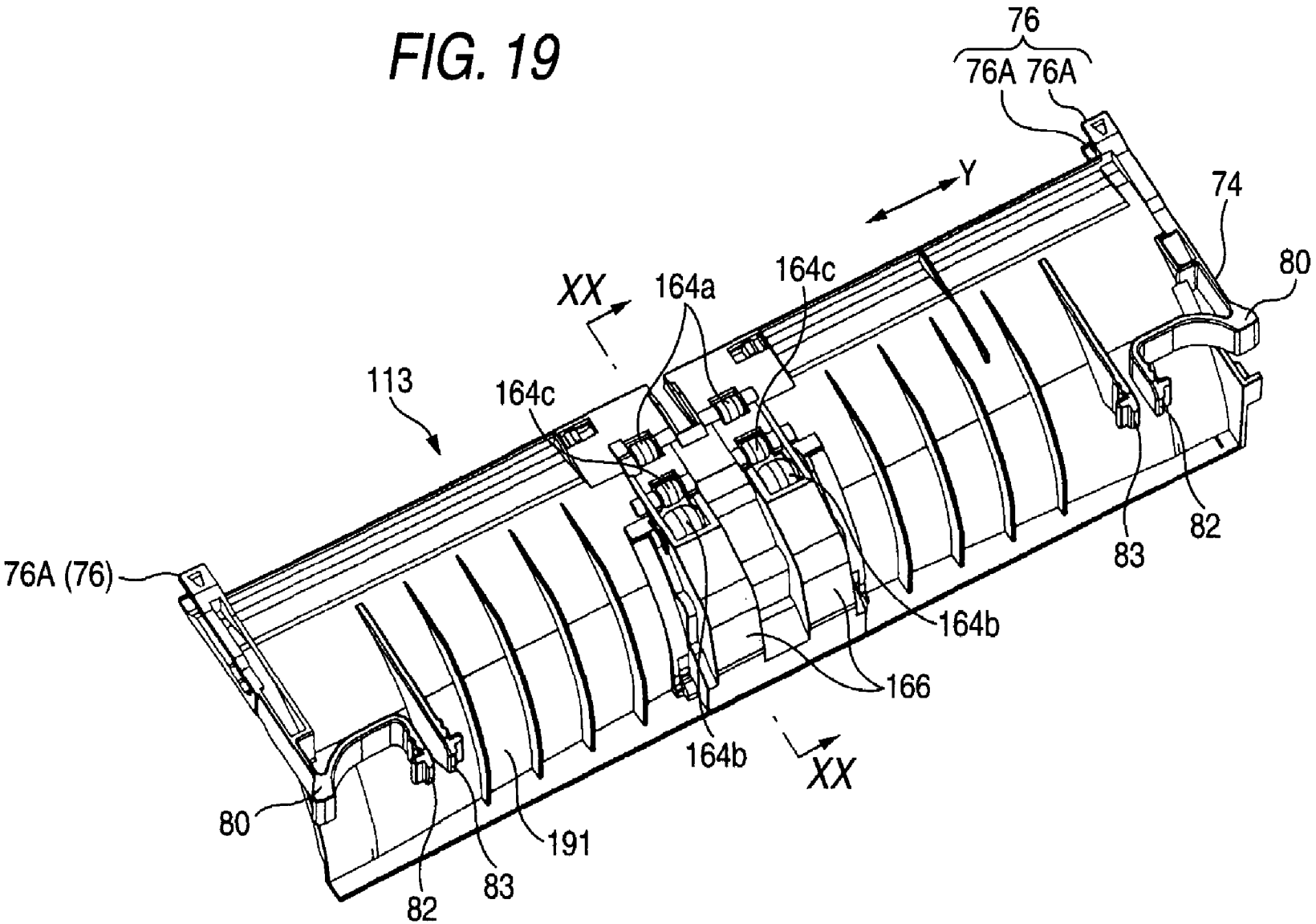
FIG. 19 is a rear perspective view illustrating the outer arcuate guide member.
Figure 20:
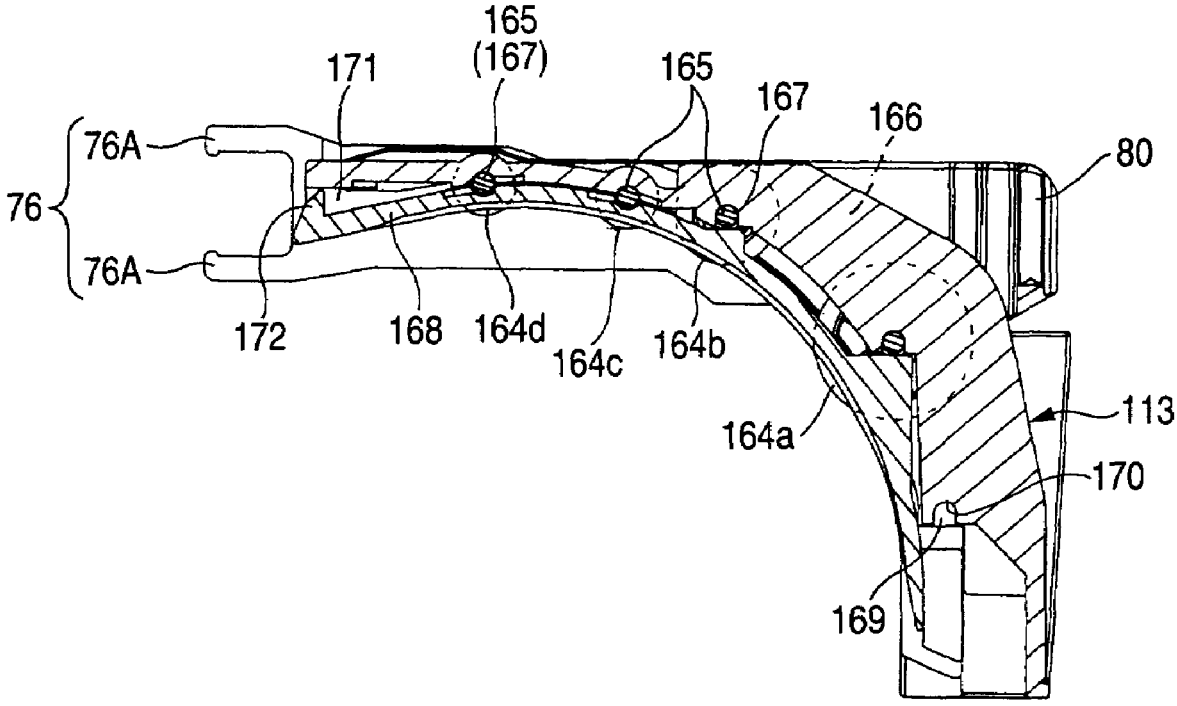
FIG. 20 is a sectional view taken along the lines XX-XX of FIGS. 18 and 19.
Figure 21A:
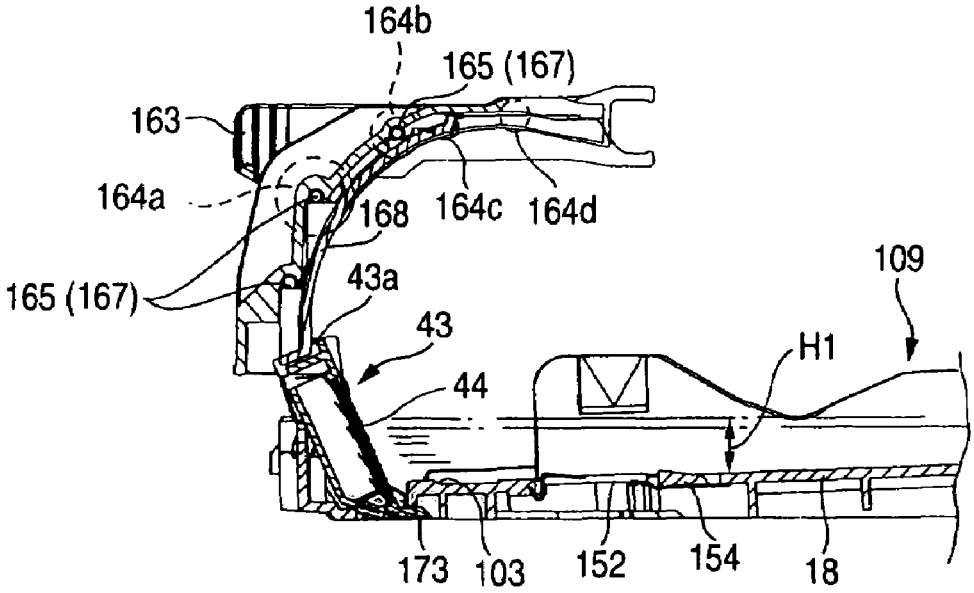
FIG. 21A is a sectional view taken along the line XXIa-XXIa of FIG. 17.
Figure 21B:
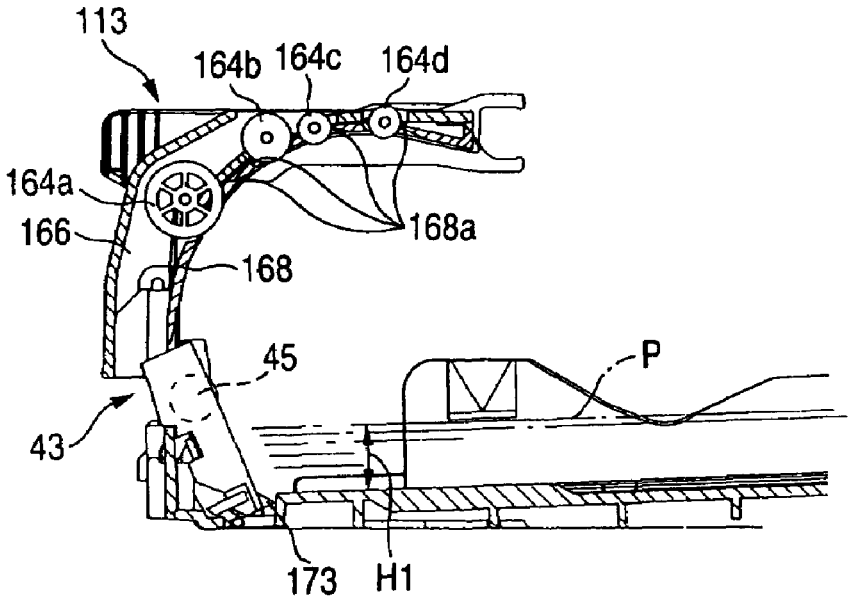
FIG. 21B is a sectional view taken along the line XXIb-XXIb of FIG. 17.
Figure 22:
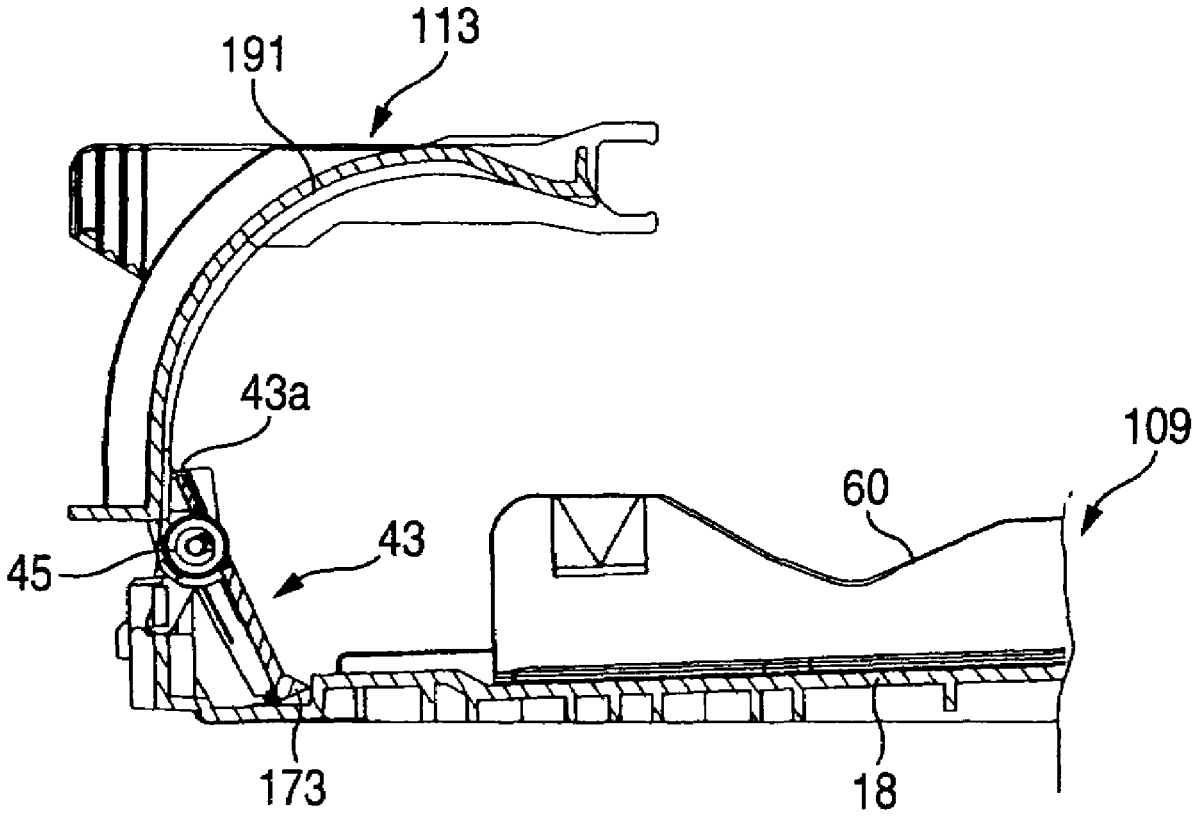
FIG. 22 is a sectional view taken along the line XXII-XXII of FIG. 17.
Figure 23:
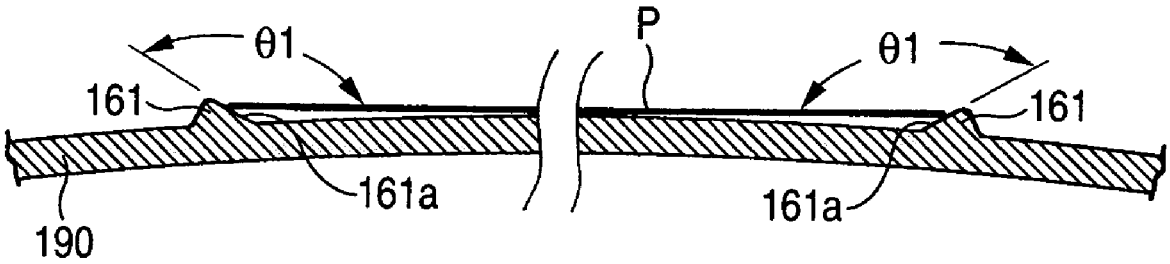
FIG. 23 is a sectional view taken along the line XXIII-XXIII of FIG. 18.

FIG. 16 is a partial enlarged sectional view of the image recording apparatus 1. FIG. 17 is a perspective view illustrating the feeding tray 109 and the outer arcuate guide member 113. FIG. 18 is a front perspective view of the outer arcuate guide member 113. FIG. 19 is a rear perspective view of the outer arcuate guide member 113. FIG. 20 is a sectional view taken along the lines XX-XX of FIGS. 18 and 19. FIG. 21A is a sectional view taken along the line XXIa-XXIa of FIG. 17. FIG. 21B is a sectional view taken along the line XXIb-XXIb of FIG. 17. FIG. 22 is a sectional view taken along the line XXII-XXII of FIG. 17. FIG. 23 is a sectional view taken along the line XXIII-XXIII of FIG. 18.

The outer arcuate guide member 113 is mounted rearward of the image recording section 11 and upward of the rear end of the feeding tray 109. The outer arcuate guide member 113 can be dismounted through a mounting guide opening 63, which is defined in the rear wall of the casing 2. The outer arcuate guide member 113 as a whole is received in the casing 2. A position of the rear end of the outer arcuate guide member 113 is substantially identical to that of the rear wall of the casing 2. The outer arcuate guide member 113 has a body portion 191, which extends in a widthwise direction thereof while being curved to have the arc shape. The body portion 191 has an outer guide surface 190 for guiding the recording medium, which faces the free passage 15. The outer guide surface 190 is formed over the substantially same range as the feeding tray 109 in the widthwise direction (a Y-direction in FIG. 17). The upstream end portion of the outer guide surface 190 is located on the upper end portion of the guide plate 43. The downstream end portion of the outer guide surface 190 is positioned immediately before the regulation roller 93 and the driven rollers 94. The outer guide surface 190 extends substantially vertically in the vicinity of an upstream end portion thereof and is gradually inclined forward toward the downstream side of the conveyance direction. Then, after extending horizontally, the outer guide surface 190 is inclined downward toward the downstream end thereof. Therefore, the outer guide surface 190 defines a substantially arc-shaped contour. The outer guide surface 190 has a flat surface in the vicinity of the downstream end portion thereof. A plurality of ribs 161 project from the outer guide surface 190 to be spaced at regular intervals from one another in the widthwise direction and extend in the conveyance direction.

The ribs 161 has a section shape, which is symmetrical with respect to the center thereof in the widthwise direction. In section, each rib 161 has an inclined surface 161*a*, which is inclined outward in the widthwise direction and has an obtuse angle θ1 with respect to the outer guide surface 190 (see FIG. 23). Preferably, the obtuse angle θ1, which is defined between the outer guide surface 190 and the inclined surface 161*a* is set to 130°~140°. If the ribs 161 are formed in this manner, when conveying a recording medium having a widthwise dimension, which substantially corresponds to the distance between a pair of ribs 161, even though a conveyance position of the recording medium is slightly deviated in the widthwise direction, the widthwise edge of the recording medium, which extends in the conveyance direction, are placed on the inclined surfaces 161*a* each having the obtuse angle θ1 so that only low sliding resistance is induced. Accordingly, it is possible to prevent the side edges of the recording medium from being caught between the inner surfaces of the ribs, which is otherwise caused in the case that the inner surfaces of the ribs are uprighted from the outer guide surface 190. As a result, it is possible to prevent meandering and jamming of the recording medium and to prevent wave-shaped stripes (corrugations), which extend in the conveyance direction, from being formed on the surface of the recording medium.

As in the case of the guide plate 43, the outer guide surface 190 of the outer arcuate guide member 113 and an envelope curve, which is defined by connecting distal ends of the ribs 161, are curved to define a convex curve surface, which is adjacent to the widthwise center portion of the recording medium and is gradually remote from the recording medium as approaching to both widthwise ends of the recording medium. For this reason, both widthwise ends of the recording medium, which is conveyed on the outer guide surface 190 of the outer arcuate guide member 113, are not much brought into contact with the outer guide surface 190 (are easily detached from the outer guide surface 190). Therefore, it is possible to decrease conveyance resistance.

A plurality of rotation rollers 164 capable of freely rotating are provided at least in the vicinity of the center of the outer arcuate guide member 113 in the widthwise direction (see FIGS. 18, 20 and 21B). The rotation rollers 164 are spaced apart at regular intervals in the conveyance direction of the recording medium. Suffixes 'a', 'b', 'c' and 'd' will be appended to the rotation rollers 164, starting from those rotation rollers located at the upstream side of the conveyance direction. The diameter of the rotation roller 164, which is located upstream in the conveyance direction, is equal to or larger than that of the rotation roller 164, which is located downstream in the conveyance direction.

In the second embodiment, the rotation rollers 164*d*, which are located most downstream, and the rotation rollers 164*c*, which are located immediately before the most downstream rotation rollers 164*d*, have the same diameter. Also, the rotation rollers 164 include a plurality of pairs of rollers so that each pair of rotation rollers are spaced apart from each other in the widthwise direction and have the same diameter.

A receiving portion 166, which can expose the rotation rollers 164*a* through 164*d* and their support shafts 165 toward the outer guide surface 190, is integrally formed in the body portion 191 of the outer arcuate guide member 113 (see FIGS. 18 through 21A). Shaft receiving portions 167, which have semi-circular grooves, are defined in the receiving portion 166 to support the support shafts 165, which project from both ends of the rotation rollers 164*a* through 164*d* (see FIG. 20).

a cover member 168 made of synthetic resin is detachably coupled to the receiving portion 166 on a side of the outer guide surface 190 to expose at least a part of each rotation roller 164*a* through 164*d* and to cover the shaft receiving portions 167, which receive the support shafts 165 (see FIGS. 18, 20 and 21A). The cover member 168 also has a U shape when viewed from the side, to extend along the outer guide surface 190. Window openings 168*a* are defined in the cover member 168 at predetermined locations so that circumferential surface portions of the rotation rollers 164*a* through 164*d* can be exposed to the outside through the window openings 168*a*. Grooves 170 are defined on the lower part of the cover member 168 so that projections 169 formed on the body portion 191 can be respectively engaged into the grooves 170. Engagement claws 172 are formed on the upper distal end of the cover member 168 so that engagement steps 171 formed on the upper distal end of the body portion 191 can be respectively engaged with the engagement claws 172 (see FIG. 20). With this configuration, the structure of the shaft receiving portions 167 for the rotation rollers 164 can be simplified, and mounting and replacement operation for the rotation rollers 164*a* through 164*d* can be improved.

As described above, the diameter of the rotation rollers 164*a*, which are located upstream in the conveyance direction, is equal to or larger than that of the rotation rollers, which are located downstream in the conveyance direction, and the circumferential surface portion of the rotation roller 164*a* projects to a slight extent from the surface of the cover member 168. For this reason, an angle measured between the surface of the cover member 168 and the circumferential surface portion of the rotation roller 164*a* becomes an obtuse angle, which is about 180°. With this configuration, it is possible to remarkably decrease resistance, which is induced when the leading end of the recording medium conveyed upward from the guide plate 43, is brought into contact with the circumferential surface portion of the rotation roller 164*a*. Thus, it is possible to reliably and smoothly convey downstream the recording medium on the outer arcuate guide member 113, which has the U shape. Thereby, jamming of the recording medium can be avoided.

The following configuration is preferable in order to prevent stripes from being formed on the recording surface of the recording medium (that is, the surface facing the outer guide surface 190). That is to say, the diameter of each rotation roller 164*a* through 164*d* gradually increases from both ends thereof toward a center portion thereof. More preferably, the largest diameter portion of the circumferential rotation surface of the rotation roller has a cylindrical surface, or the entire circumferential rotation surface of the rotation roller is formed into a bulged surface. With this configuration, since stripes are not formed on the recording surface of the recording medium, it is possible to prevent an image formed in the succeeding image recording section 11 from being deteriorated in its quality. Also, by removing (that is, rounding) the edges of each rotation roller 164*a* through 164*d*, it is possible to reliably prevent stripes from being formed on the recording surface of the recording medium. Hence, quality of the image can be further ameliorated.

Figure 24:
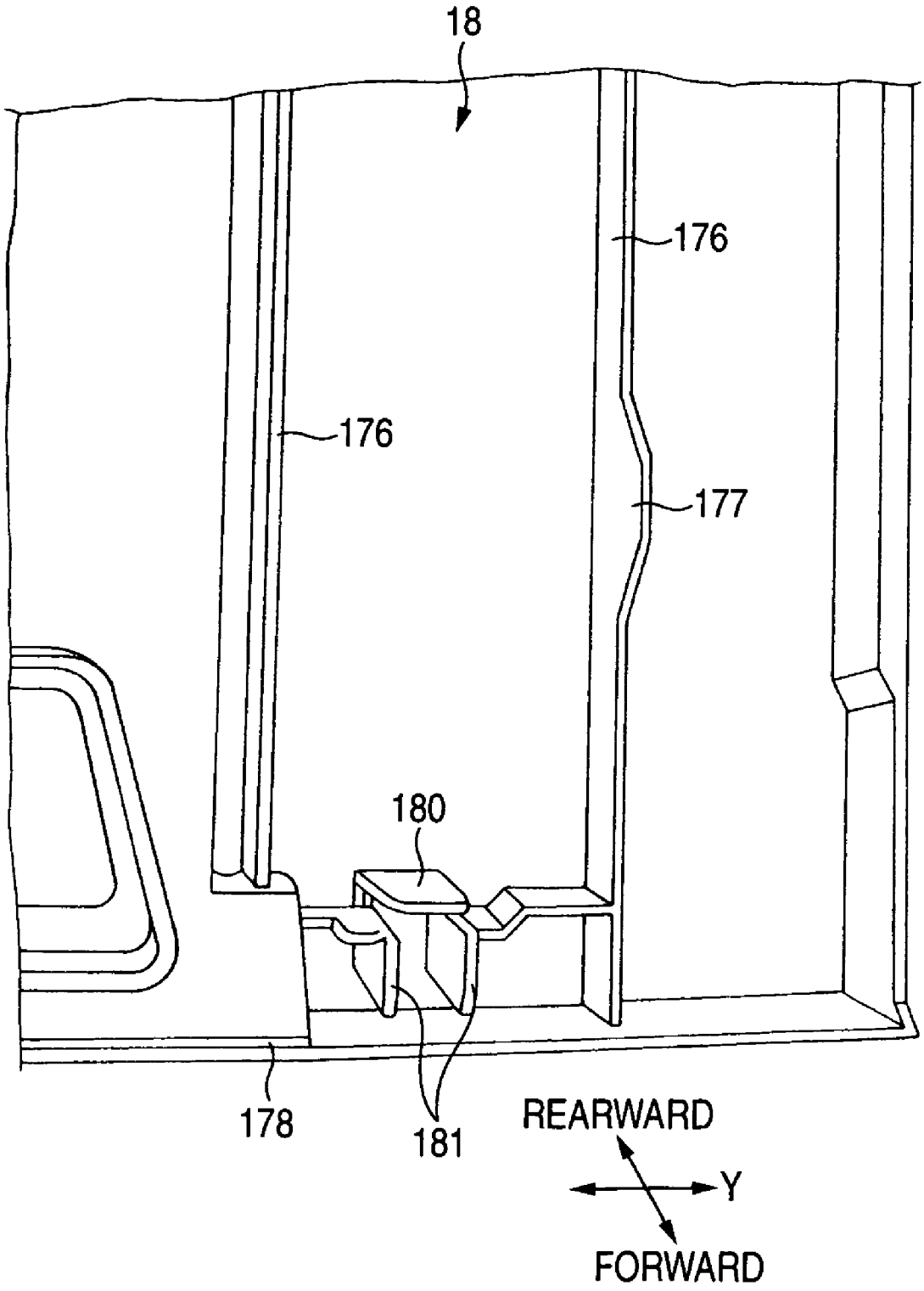
FIG. 24 is a perspective view illustrating an engagement claw and a cam portion which are formed on the lower surface of the feeding tray.
Figure 25:
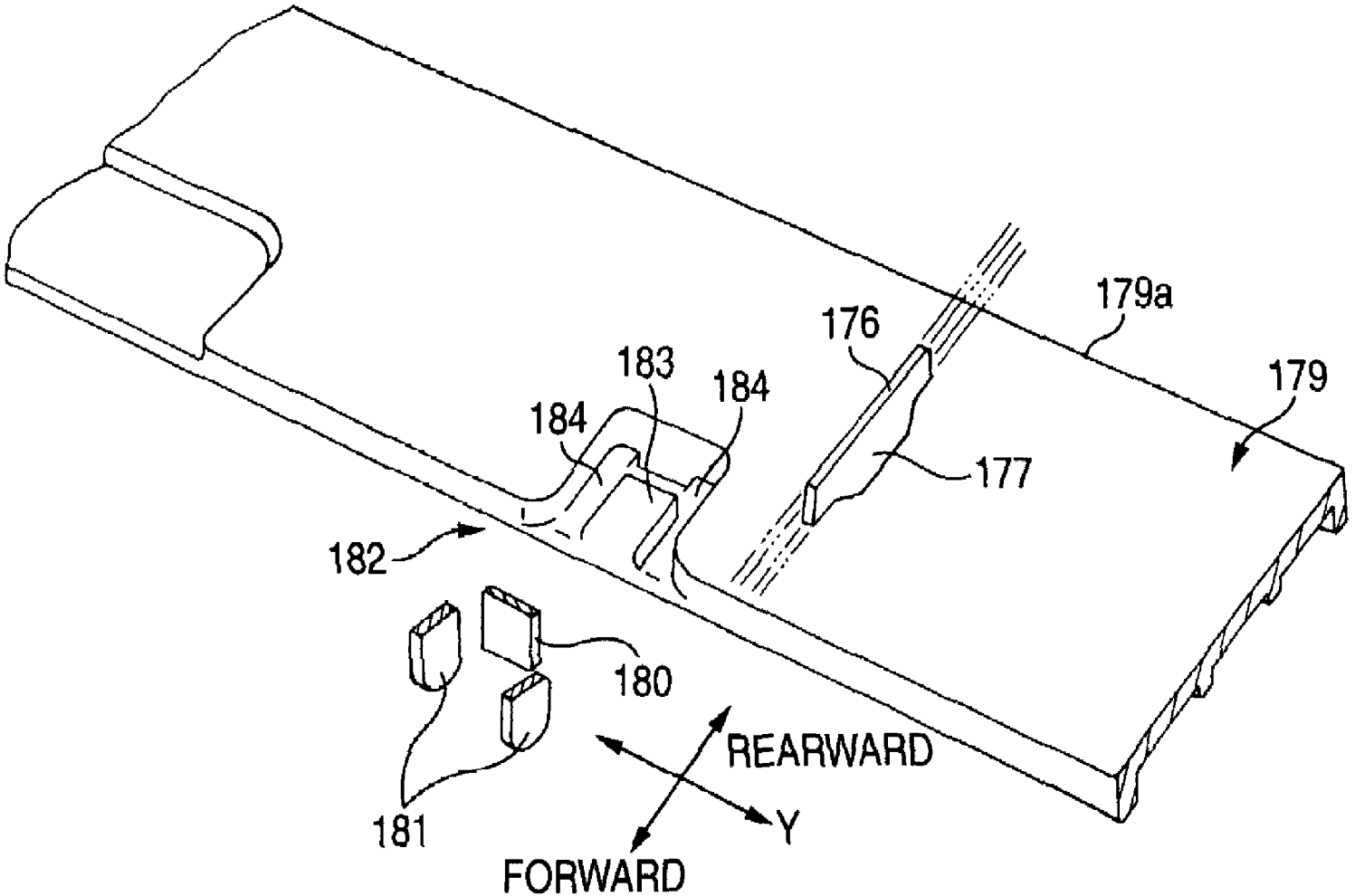
FIG. 25 is a perspective view illustrating a connection piece which is formed on the bottom of the casing.
Figure 26:
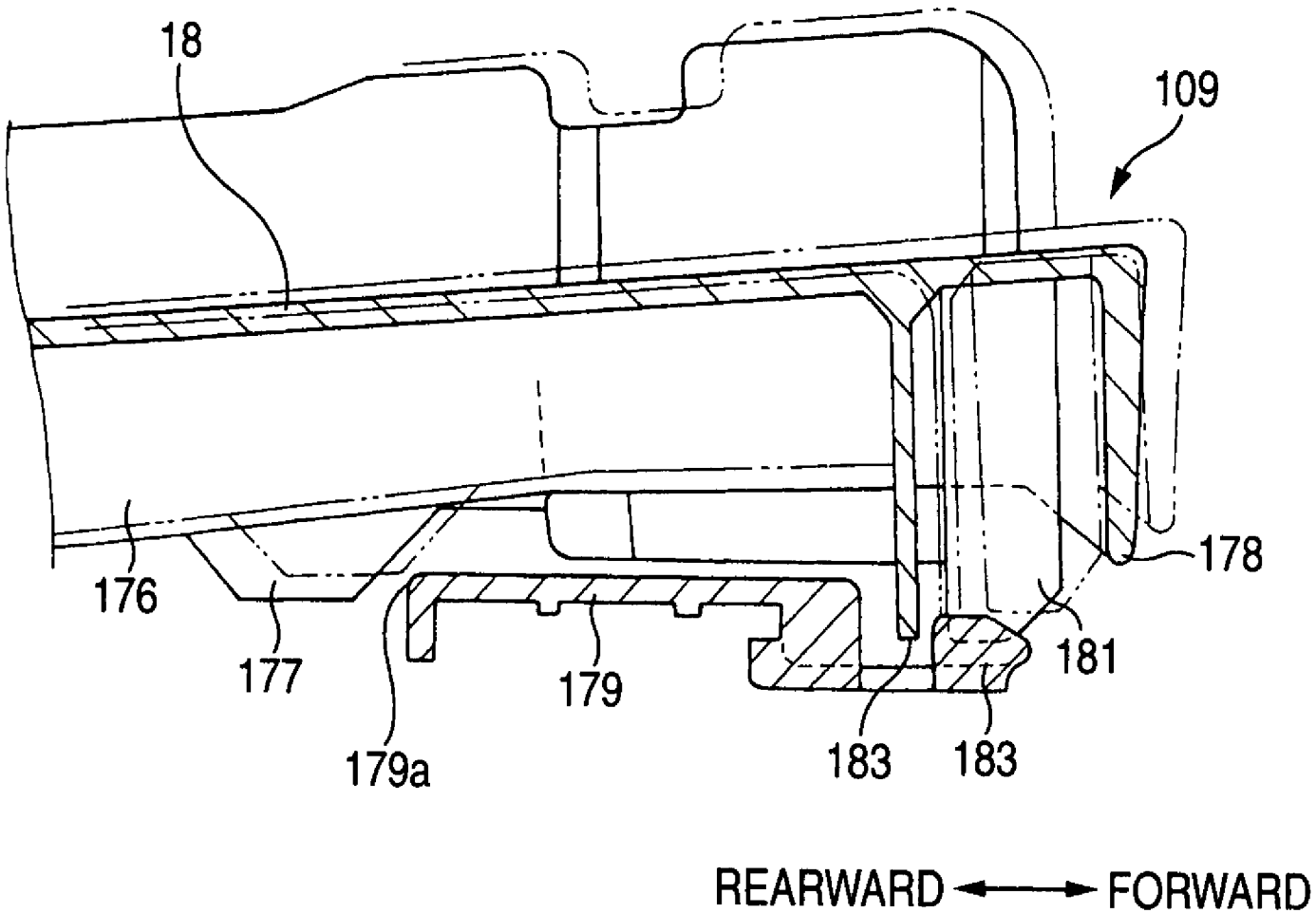
FIG. 26 is a side view explaining operation for removing the feeding tray which is in an engaged state.

FIGS. 24 through 26 illustrate a configuration for maintaining an engaged state in which the feeding tray 109 is substantially horizontally inserted through the opening 8 of the casing 2 and for easily releasing the engaged state when removing the feeding tray 109 from casing 2. Specifically, reinforcing ribs 176, which extend in the insertion direction of the feeding tray 109 through the opening 8 (that is, the conveyance direction of the recording medium), are integrally formed on the lower surface of the base plate 18 of the feeding tray 109. A cam portion 177, which has a substantially trapezoidal shape when viewed from the side, is integrally formed on the reinforcing rib 176 to project downward. The reinforcing ribs 176 and the cam portions 177 are appropriately spaced apart from one another in the Y-direction at a plurality of locations (in this embodiment, at two locations). Meanwhile, a connection piece 179 is integrally formed on the bottom of the casing 2 to extend in a direction (Y-direction), which is perpendicular to the insertion direction of the feeding tray 109 (see FIGS. 25 and 26).

When the feeding tray 109 is substantially horizontally inserted into the casing 2, the lower edge of the cam portion 177 is brought into sliding contact with the upper surface of the connection piece 179. In a state where the insertion of the feeding tray 109 is completed, since the cam portion 177 is located in a space, which is defined rearward of the rear edge 179*a* of the connection piece 179, the lower edge of the cam portion 177 is separated in a downward direction from the upper surface of the connection piece 179 (see the solid line in FIG. 26). On the contrary, when the feeding tray 109 is removed, the front edge of the cam portion 177 is brought into contact with the rear edge 179*a* of the connection piece 179. Then, in a state where the lower edge of the cam portion 177 runs on the upper surface of the connection piece 179, the cam portion 177 is substantially horizontally moved toward the front end of the casing 2 (see the two-dot chain line in FIG. 26). The cam portion 177 and the connection piece 179 constitute a cam portion.

Also, between a front end reinforcing plate 178 and the cam portion 177 of the feeding tray 109, a plate-shaped engagement claw 180 and a pair of left and right guide elements 181 between which the engagement claw 180 is located are integrally formed on the lower surface of the feeding tray 109 to project downward (see FIGS. 24 through 26). The engagement claw 180 is long in the Y-direction and is flat in a forward and rearward direction. The guide elements 181 are long in the forward and rearward direction and are flat in the Y-direction. An engagement portion 182 is formed at the front end of the connection piece 179 at positions corresponding to the engagement claw 180 and the pair of guide elements 181. The engagement portion 182 has a protrusion 183 for maintaining an engaged state of the engagement claw 180 and a pair of guide grooves (leading grooves) 184, which are defined on both sides of the protrusion 183 to extend in the forward and rearward direction and open forward (see FIGS. 25 and 26).

In this configuration, if the feeding tray 109 is inserted into the casing 2, the lower edge of the cam portion 177 runs on the upper surface of the connection piece 179. In this state, the lower edge of the engagement claw 180 is also pressed inward while being brought into sliding contact with the upper surface of the protrusion 183. If the front edge of the cam portion 177 is moved inward beyond the rear edge 179*a* of the connection piece 179, at substantially the same time (upon completion of insertion movement), the lower edge of the engagement claw 180 also goes beyond the rear end of the protrusion 183. For this reason, the feeding tray 109 is lowered in a substantially horizontal state. As a result, the engagement claw 180 is engaged with the rear end surface of the protrusion 183, whereby a set state of the feeding tray 109 with respect to the casing 2 can be stably held.

In the case of removing the feeding tray 109, as described above, when the lower edge of the cam portion 177 runs on the upper surface of the connection piece 179, the front edge of the feeding tray 109 is raised by a predetermined height (see the sold line and the two-dot chain line in FIG. 26). Therefore, this fact, at the same time, the lower edge of the engagement claw 180 is also lightly sliding contact with the upper surface of the protrusion 183. In this way, release of the engagement between the engagement claw 180 and the engagement portion 182 can be facilitated. Therefore, it is possible to reduce deformation, wear and whitening of resin due to forceful contact of the lower edge of the engagement claw 180 with the protrusion 183 during repeated insertion and removal of the feeding tray 109. Further, a click feeling can be afforded to a user upon insertion and removal of the feeding tray 109.

As described above, according to this second embodiment, the plurality of rotation rollers 164 having small diameters and capable of freely rotating are provided on the outer guide surface 190 of the outer arcuate guide member 113 having the U shape, in the vicinity of the center portion of the recording medium in the widthwise direction. Due to this tact, a compact construction can be accomplished while reliable and smooth conveyance of the recording medium to the image recording section 11 is ensured.

Also, the diameter of the rotation roller 164, which is located upstream in the conveyance direction, is equal to or larger than that of the rotation roller 164, which is located downstream in the conveyance direction. Therefore, diameters of the rotation rollers 164 gradually decrease in the conveyance direction. As a result, the exposed circumferential surface portions of the rotation rollers 164 substantially conform to the outer guide surface 190 of the outer arcuate guide member 113. Also, it is possible to decrease a height by which the rotation roller 164 projects beyond the outer guide surface 190. As a result, it is possible to remarkably decrease resistance, which is induced when the leading end of the recording medium conveyed upward frog the guide plate 43, is brought into contact with the circumferential surface portions of the rotation rollers 164. Further, it is possible to reliably and smoothly convey downstream the recording medium on the outer arcuate guide member 113 having the U shape, whereby jamming of the recording medium can be avoided.

Moreover, by mounting the cover member 168, it is possible to simply locate and install the plurality of rotation rollers 164, so that the support shafts 165 cannot be unintentionally released from the shaft receiving portions 167.

Furthermore, because the outer arcuate guide member 113 (the outer guide surface 190) and the ribs 161 have the convex curved contours, both widthwise ends of the recording medium, which is conveyed on the outer arcuate guide member 113, are not brought into contact with the outer guide surface 190 and the distal end surfaces of the ribs 161. Therefore, since conveyance resistance decreases, the recording medium can be reliably conveyed.

In addition, the ribs 161 located outward of the rotation rollers 164 in the widthwise direction of the outer guide surface 190 are formed in a manner such that the inner surface of each rib 161, which faces the widthwise center of the outer guide surface 190, is inclined outward to define an obtuse angle with respect to the outer guide surface 190. Therefore, since the recording medium is conveyed in a state where both widthwise edges of the recording medium are placed on the inclined surfaces 161*a* of the ribs 161, it is possible to prevent meandering and jamming of the recording medium.

Because the leading end of the widthwise center portion of the recording medium collides against the separating member 44, which is provided on the widthwise center portion of the guide plate 43, it is possible reliably separate overlapped recording media one by one. Consequently, it is possible to prevent the overlapped conveyance of the recording media.

Between the base plate 18 of the feeding tray 109 and the lower end of the guide plate 43, the plurality of auxiliary ribs 173 are integrally formed on the lower end of the guide plate 43 to fill the gap, which is created due to the curved contour of the guide plate 43. Due to the presence of the auxiliary ribs 173, when the number of recording media accommodated in the feeding tray 109 decreases and the recording medium is conveyed with being adjacent to the base plate 18 is conveyed, the leading end of the recording medium is prevented from being caught in the gap, whereby the recording medium can be reliably guided upward of the guide plate 43.

The cork plate 152 is provided on the base plate 18 of the feeding tray 109 at a position facing the feeding section 16. Downstream of the cork plate 152 in the conveyance direction, the upward guiding portion 103 is provided on the base plate 18 between the cork plate 152 and the lower end of the guide plate 43. The upward guiding portion 103 has the inclined surface, which is low on the side of the cork plate 152 and is gradually increased in its height toward the lower end of the guide plate 43. With this configuration, when the number of recording media accommodated in the feeding tray 109 decreases and the recording medium is conveyed with being adjacent to the base plate 18, the leading end of the recording medium can be reliably guided upward along the upward guiding portion 103. As a result, the recording medium is prevented from being caught in the gap and can be reliably guided upward of the guide plate 43.

The upper end of the guide plate 43 extends upward beyond the lower end of the outer guide surface 190 of the outer arcuate guide member 113 so that the guide plate 43 and the outer guide surface 190 partially overlap with each other. Therefore, even when the recording medium is fed in the vicinity of a maximum accommodation position of the recording media, the recording medium can reliably transfer from the guide plate 93 to the lower end of the outer arcuate guide member 113.

Other Embodiments

It is to be noted that the present invention is not limited to the embodiments described above and illustrated in the drawings. For example, the following modifications also fall within the scope of the present invention. Therefore, various changes may be made without departing from the spirit of the present invention.

(1) While in the above embodiments, he feeding tray is removably inserted into the body of the image recording apparatus, the present invention can be applied to a feeding tray, hich cannot be removed from the body of the image recording apparatus.

(2) While in the above embodiments, the image recording section and the recording media accommodation section are arranged up and down, the present invention can be applied to the case where positional relationships of the image recording section and the recording media accommodation section bottom are reversed.

(3) The image recording apparatus according to the above-described embodiments can be used in a manner such that a recording medium is fed from the outside of the body. That is to say, in a state where the outer arcuate guide member is removed through the mounting guide opening, an external unit which has a second accommodation section and a conveyance unit for feeding a recording medium accommodated in the second recording medium accommodation section can be mounted to the body of the apparatus. Therefore, by feeding the recording medium from the second accommodation section through the mounting guide opening to the image recording section located inside the body of the apparatus, using the conveyance unit, it is possible to record an image on the recording medium.

What is claimed is:

1. An image recording apparatus comprising:

an accommodation section on which sheet-like recording media are stacked;

an image recording section that forms an image on a recording medium conveyed in a conveyance direction, the accommodation section and the image recording section being arranged in an up and down direction;

an outer arcuate guide member that connects in a U-shape the accommodation section with the image recording section, the outer arcuate guide member guiding the recording medium from a downstream end portion of the accommodation section in the conveyance direction to an insertion port of the image recording section;

an inner arcuate guide member that is disposed to be separate from the outer arcuate guide member, a passage being defined between the outer arcuate guide member and the inner arcuate guide member, the passage allowing the recording medium conveyed to displace in a thickness direction of the recording medium;

a feeding section that separates one of the stacked recording media from the remaining recording media to feed the one of the recording media to the passage; and a conveyance roller disposed at the insertion port of the image recording section, wherein:

the outer arcuate guide member comprises an engagement portion that engages with a rotation shaft of the conveyance roller.

2. The image recording apparatus according to claim 1, further comprising:

a casing, wherein:

the outer arcuate guide member is attached to the image recording apparatus so that the outer arcuate guide member is detachable from an outside of the casing.

3. The image recording apparatus according to claim 1, wherein:

the outer arcuate guide member defines a guide groove; and the casing comprises a guide protrusion that engages with the guide groove to guide the outer arcuate guide member to an attachment position.

4. The image recording apparatus according to claim 1, wherein an outer side edge of the outer arcuate guide member is substantially flush with a side surface of the casing.

5. An image recording apparatus comprising:

an accommodation section on which sheet-like recording media are stacked;

an image recording section that forms an image on a recording medium conveyed in a conveyance direction, the accommodation section and the image recording section being arranged in an up and down direction;

an outer arcuate guide member that connects in a U-shape the accommodation section with the image recording section, the outer arcuate guide member guiding the recording medium from a downstream end portion of the accommodation section in the conveyance direction to an insertion port of the image recording section;

an inner arcuate guide member that is disposed to be separate from the outer arcuate guide member, a passage being defined between the outer arcuate guide member and the inner arcuate guide member, the passage allowing the recording medium conveyed to displace in a thickness direction of the recording medium;

a feeding section that separates one of the stacked recording media from the remaining recording media to feed the one of the recording media to the passage; and a casing, wherein:

the outer arcuate guide member is attached to the image recording apparatus so that the outer arcuate guide member is detachable from an outside of the casing, the outer arcuate guide member includes:

a handle portion used to attach and detach the outer arcuate guide member;

a locking portion that is elastically engageable with an engaged portion provided in the casing in a state where the outer arcuate guide member is attached to an attachment position; and a release operation portion; and when the handle portion and the release operation portion are grasped simultaneously, the release operation portion deforms the locking portion to release the engagement between the locking portion and the engaged portion.

6. An image recording apparatus comprising:

an accommodation section on which sheet-like recording media are stacked;

an image recording section that forms an image on a recording medium conveyed in a conveyance direction, the accommodation section and the image recording section being arranged in an up and down direction;

an outer arcuate guide member that connects in a U-shape the accommodation section with the image recording section, the outer arcuate guide member guiding the recording medium from a downstream end portion of the accommodation section in the conveyance direction to an insertion port of the image recording section;

an inner arcuate guide member that is disposed to be separate from the outer arcuate guide member, a passage being defined between the outer arcuate guide member and the inner arcuate guide member, the passage allowing the recording medium conveyed to displace in a thickness direction of the recording medium; and a feeding section that separates one of the stacked recording media from the remaining recording media to feed the one of the recording media to the passage, wherein:

the outer arcuate guide member comprises a surface that faces the inner arcuate guide member;

the outer arcuate guide member comprises a resistance reducing portion, which is made of a synthetic resin having smaller friction resistance against the recording medium than that of a synthetic resin forming the other portion of the outer arcuate guide member; and the resistance reducing portion is disposed at a center portion of the outer arcuate guide member in a width direction.

7. The image recording apparatus according to claim 6, wherein the inner arcuate guide member comprises an auxiliary roller that is disposed at an upstream end portion of the inner arcuate guide member in the conveyance direction, the auxiliary roller being rotateable.

8. An image recording apparatus comprising:

an accommodation section on which sheet-like recording media are stacked;

an image recording section that forms an image on a recording medium conveyed in a conveyance direction, the accommodation section and the image recording section being arranged in an up and down direction;

an outer arcuate guide member that connects in a U-shape the accommodation section with the image recording section, the outer arcuate guide member guiding the recording medium from a downstream end portion of the accommodation section in the conveyance direction to an insertion port of the image recording section;

an inner arcuate guide member that is disposed to be separate from the outer arcuate guide member, a passage being defined between the outer arcuate guide member and the inner arcuate guide member, the passage allowing the recording medium conveyed to displace in a thickness direction of the recording medium; and a feeding section that separates one of the stacked recording media from the remaining recording media to feed the one of the recording media to the passage, wherein:

the outer arcuate guide member comprises a plurality of rollers at a center portion thereof in a width direction, the outer arcuate guide member comprises a receiving portion and a cover member, the outer arcuate guide member comprises a surface that faces the inner arcuate guide member, the receiving portion receives therein the rollers and shafts of the rollers with exposing the rollers and the shafts of the rollers toward the surface of the outer arcuate guide member, and the cover member is detachably attached to the surface of the outer arcuate guide member to expose at least a part of the rollers and cover the shafts of the rollers.

9. The image recording apparatus according to claim 8, wherein:

the rollers are arranged at predetermined intervals in the conveyance direction; and a diameter of one roller located upstream in the conveyance direction is equal to or larger than that of another roller located downstream in the conveyance direction.

10. The image recording apparatus according to claim 8, wherein the diameter of each roller gradually increases from both end portions of each roller to a center portion of each roller.

11. The image recording apparatus according to claim 8, wherein:

edges of each roller are rounded; and a circumferential surface of each roller and end surfaces of each roller intersect with each other at the edges of each roller.

12. An image recording apparatus comprising:

an accommodation section on which sheet-like recording media are stacked;

an image recording section that forms an image on a recording medium conveyed in a conveyance direction, the accommodation section and the image recording section being arranged in an up and down direction;

an outer arcuate guide member that connects in a U-shape the accommodation section with the image recording section, the outer arcuate guide member guiding the recording medium from a downstream end portion of the accommodation section in the conveyance direction to an insertion port of the image recording section;

an inner arcuate guide member that is disposed to be separate from the outer arcuate guide member, a passage being defined between the outer arcuate guide member and the inner arcuate guide member, the passage allowing the recording medium conveyed to displace in a thickness direction of the recording medium;

a feeding section that separates one of the stacked recording media from the remaining recording media to feed the one of the recording media to the passage;

a casing; and a cam member;

wherein:

the casing comprises an engaged portion;

the accommodation section comprises an engagement claw at an end portion of a lower surface thereof an engagement;

when the accommodation section is completely inserted into the casing, the engagement claw of the accommodation section engages with the engaged portion of the casing; and when the accommodation section is pulled from the casing, the cam member guides the accommodation section upward to release the engagement between the engagement claw and the engaged portion.

13. The image recording apparatus according to claim 12, wherein the outer arcuate guide member comprises a plurality of rollers at a center portion thereof in a width direction.

14. An image recording apparatus comprising:

a main body;

an image recording unit that forms an image on a recording medium;

a conveying path through which the recording medium is fed to the image recording unit, the image recording unit and the conveying path being disposed in the main body;

a feed cassette disposed at a lower portion of the main body and below the image recording unit so as to be movable forward and rearward, the feed cassette being capable of accommodating a stack of recording media therein;

a feeding roller that feeds the recording medium from the stack on the feed cassette to the conveying path; and a separating unit that is disposed at an end portion of the feed cassette to separate the recording medium from the stack and cooperate with the feeding roller to convey the separated recording medium upward to the conveying path, wherein:

the conveying path comprises a conveying-path member having a plate portion of a U-shape in a side view;

the conveying-path member includes a plurality of rollers that are freely rotatable provided at a central portion thereof in a widthwise direction perpendicular to a conveyance direction of the recording medium;

the plurality of rollers are arranged in the conveyance direction of the recording medium;

the plurality of rollers are always separated from the feeding roller when the recording medium is fed to the recording unit; and a diameter of one roller located upstream in the conveyance direction is larger than that of another roller located downstream in the conveyance direction.

15. An image recording apparatus comprising:

an accommodation section on which sheet-like recording media are stacked;

an image recording section that forms an image on a recording medium conveyed in a conveyance direction, the accommodation section and the image recording section being arranged in an up and down direction;

an outer arcuate guide member that connects in a U-shape the accommodation section with the image recording section, the outer arcuate guide member guiding the recording medium from a downstream end portion of the accommodation section in the conveyance direction to an insertion port of the image recording section, the outer arcuate guide member including a surface that faces the inner arcuate guide member;

an inner arcuate guide member that is disposed to be separate from the outer arcuate guide member, a passage being defined between the outer arcuate guide member and the inner arcuate guide member, the passage allowing the recording medium conveyed to displace in a thickness direction of the recording medium;

a feeding section that separates one of the stacked recording media from the remaining recording media to feed the one of the recording media to the passage; and a plurality of ribs that protrude from the surface of the outer arcuate guide member, the ribs extending in the conveyance direction of the recording medium, the ribs being arranged at predetermined intervals in a width direction of the outer arcuate guide member, wherein a tip end of one rib is farther from a surface of the inner arcuate guide member than that of another rib, which is closer than the one rib to a center portion of the outer arcuate guide member in a width direction.

16. The image recording apparatus according to claim 15, wherein the accommodation section includes a guide plate that guides a leading end of the recording medium upwardly, wherein a center portion of the guide plate in a width direction bulges more than the other portion of the guide plate, and wherein the guide plate includes a separating member at the center portion thereof, the separating member separating recording media, which are fed while being overlapped with each other.

17. The image recording apparatus according to claim 16, wherein the guide plate comprises auxiliary rollers on both sides of the separating member in the width direction, respectively, the auxiliary roller being rotateable.

18. The image recording apparatus according to claim 16, wherein:

the outer arcuate guide member comprises a surface that faces the inner arcuate guide member; and an upper end of the guide plate extends to be higher than a lower end of the outer arcuate guide member on a side of the surface of the outer arcuate guide member.

19. The image recording apparatus according to claim 15, wherein:

the outer arcuate guide member comprises a convex curved surface that faces the inner arcuate guide member;

the convex curved surface bulges more at the center portion of the outer arcuate guide member than the other portions of the outer arcuate guide member.

20. The image recording apparatus according to claim 15, wherein:

the outer arcuate guide member comprises a convex curved surface that faces the inner arcuate guide member; and the convex curved surface protrudes at a center portion of the outer arcuate guide member in a width direction and retreats gradually as approaching to both end portions of the outer arcuate guide member in a width direction.

21. The image recording apparatus according to claim 15, wherein:

the outer arcuate guide member comprises a surface that faces the inner arcuate guide member;

a plurality of ribs protrude from the surface of the outer arcuate guide member, the ribs extending in the conveyance direction of the recording medium, the ribs being arranged at predetermined intervals in a width direction of the outer arcuate guide member; and each rib inclines outward in the width direction to define an obtuse angle between the each rib and the width direction.

22. The image recording apparatus according to claim 21, wherein:

the surface of the outer arcuate guide member is a convex curved surface; and the convex curved surface bulges more at the center portion of the outer arcuate guide member than the other portions of the outer arcuate guide member.

23. An image recording apparatus comprising:

an accommodation section on which sheet-like recording media are stacked, the accommodation section including a guide plate that guides a leading end of the recording medium upwardly;

an image recording section that forms an image on a recording medium conveyed in a conveyance direction, the accommodation section and the image recording section being arranged in an up and down direction;

an outer arcuate guide member that connects in a U-shape the accommodation section with the image recording section, the outer arcuate guide member guiding the recording medium from a downstream end portion of the accommodation section in the conveyance direction to an insertion port of the image recording section;

an inner arcuate guide member that is disposed to be separate from the outer arcuate guide member, a passage being defined between the outer arcuate guide member and the inner arcuate guide member, the passage allowing the recording medium conveyed to displace in a thickness direction of the recording medium; and a feeding section that separates one of the stacked recording media from the remaining recording media to feed the one of the recording media to the passage, wherein the center portion of the guide plate in the width direction bulges more than the other portion of the guide plate, and the guide plate includes a separating member at the center portion thereof, the separating member separating recording media, which are fed while being overlapped with each other.

24. The image recording apparatus according to claim 23, wherein:

a rib is disposed in a groove between a base plate of the accommodation section and a lower end of the guide plate, and is integrated with the lower portion of the guide plate.

25. The image recording apparatus according to claim 23, wherein:

the accommodation section comprises on a base plate thereof:

a resistance member at a position facing the feeding section; and an upward guiding portion disposed on downstream of the resistance member in the conveyance direction and between a lower portion of the guide plate and the resistance member; and the upward guiding portion has a height, which gradually increases from the resistance member toward the lower end of the guide plate.

* * * * *

UNITED STATES PATENT AND TRADEMARK OFFICE

CERTIFICATE OF CORRECTION

PATENT NO. : 7,435,025 B2
APPLICATION NO. : 11/071194
DATED : October 14, 2008
INVENTOR(S) : Naokazu Tanahashi et al.

It is certified that error appears in the above-identified patent and that said Letters Patent is hereby corrected as shown below:

On the Title Page, Item 56:
Please insert additional U.S. Patent Documents:

--7,108,257 9/19/2006 SHIOHARA et al.
5,002,266 3/26/1991 KIKUCHI et al.--

On the Title Page, Item 56:
Please insert additional Foreign Patent Documents:

--JP 2003-146465 5/21/2003
JP 09-188450 7/22/1997
JP 11-130311 5/18/1999
JP 2000-309445 11/7/2000
JP 2003-292183 10/15/2003
JP 02-225237 9/7/1990
JP 2003-081468 3/19/2003
JP 64-034820 2/6/1989
JP 01-172127 7/7/1989
JP 2004-051333 2/19/2004
JP 2003-182864 7/3/2003
JP 07-144786 6/6/1995
JP 2003-048638 2/21/2003
JP 09-286547 11/4/1997--

UNITED STATES PATENT AND TRADEMARK OFFICE

CERTIFICATE OF CORRECTION

PATENT NO. : 7,435,025 B2
APPLICATION NO. : 11/071194
DATED : October 14, 2008
INVENTOR(S) : Naokazu Tanahashi et al.

It is certified that error appears in the above-identified patent and that said Letters Patent is hereby corrected as shown below:

On the Title Page, Item 56:
Please insert additional Other Publications:

--Notification of Reason for Refusal dispatched June 11, 2008 in Japanese Application No. 2004-188294 and English translation thereof.--

Signed and Sealed this

Ninth Day of June, 2009

JOHN DOLL
*Acting Director of the United States Patent and Trademark Office*